US008890910B2

(12) United States Patent
Messmer

(10) Patent No.: US 8,890,910 B2
(45) Date of Patent: Nov. 18, 2014

(54) IMAGE DISPLAY BASED ON MULTIPLE BRIGHTNESS INDICATORS

(75) Inventor: Neil Messmer, Langley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 204 days.

(21) Appl. No.: 13/377,540

(22) PCT Filed: Jul. 15, 2010

(86) PCT No.: PCT/US2010/042050

§ 371 (c)(1),
(2), (4) Date: Dec. 10, 2011

(87) PCT Pub. No.: WO2011/011249

PCT Pub. Date: Jan. 27, 2011

(65) Prior Publication Data

US 2012/0081387 A1 Apr. 5, 2012

Related U.S. Application Data

(60) Provisional application No. 61/227,652, filed on Jul. 22, 2009.

(51) Int. Cl.
*G09G 5/02* (2006.01)
*G09G 3/34* (2006.01)

(52) U.S. Cl.
CPC ..... *G09G 3/3426* (2013.01); *G09G 2320/0261* (2013.01); *G09G 2320/0646* (2013.01); *G09G 2320/066* (2013.01); *G09G 2360/16* (2013.01)
USPC ..... 345/694; 345/690; 345/102

(58) Field of Classification Search
CPC ..... G09G 3/3426
USPC ..... 345/102
See application file for complete search history.

(56) References Cited

U.S. PATENT DOCUMENTS

| | | | | |
|---|---|---|---|---|
| 7,176,878 | B2 | 2/2007 | Lew | |
| 7,377,652 | B2 | 5/2008 | Whitehead | |
| 7,419,267 | B2 | 9/2008 | Whitehead | |
| 7,532,192 | B2 | 5/2009 | Feng | |
| 7,581,837 | B2 | 9/2009 | Whitehead | |
| 2004/0257329 | A1 | 12/2004 | Park | |
| 2005/0248593 | A1 | 11/2005 | Feng | |
| 2007/0285382 | A1 | 12/2007 | Feng | |
| 2008/0042927 | A1 | 2/2008 | Jung | |
| 2008/0074060 | A1 | 3/2008 | Ye | |
| 2008/0150853 | A1 | 6/2008 | Peng | |
| 2008/0180465 | A1 * | 7/2008 | Whitehead et al. | 345/694 |

(Continued)

FOREIGN PATENT DOCUMENTS

| | | |
|---|---|---|
| CN | 1797082 | 7/2006 |
| CN | 1842834 | 10/2006 |

(Continued)

*Primary Examiner* — Alexander Eisen
*Assistant Examiner* — Sanjiv D Patel

(57) ABSTRACT

Methods for controlling light sources in displays in response to image data determine both a central tendency for brightness and an upper extreme for brightness of an area of an image. Brightness of a light source is controlled based upon both the central tendency and the upper extreme. Controllers in displays such as televisions, computer monitors, digital cinema and the like may control light source in a manner that reduces or avoids perceptible haloing.

16 Claims, 13 Drawing Sheets

(56) References Cited

U.S. PATENT DOCUMENTS

| | | | | |
|---|---|---|---|---|
| 2008/0180466 | A1* | 7/2008 | Whitehead et al. | 345/698 |
| 2009/0096710 | A1 | 4/2009 | Raman | |
| 2009/0115718 | A1* | 5/2009 | Qiao et al. | 345/102 |
| 2009/0174638 | A1* | 7/2009 | Brown Elliott et al. | 345/88 |
| 2009/0201320 | A1* | 8/2009 | Damberg et al. | 345/694 |
| 2010/0091045 | A1* | 4/2010 | Heidrich et al. | 345/690 |
| 2011/0115826 | A1* | 5/2011 | Fujiwara | 345/690 |
| 2012/0218324 | A1* | 8/2012 | Whitehead et al. | 345/694 |

FOREIGN PATENT DOCUMENTS

| | | | | |
|---|---|---|---|---|
| EP | 2202718 | A1 * | 6/2010 | G09G 3/34 |
| KR | 2008111502 | | 12/2008 | |
| WO | 2006/010244 | | 2/2006 | |
| WO | 2008/094153 | | 8/2008 | |
| WO | WO 2008094153 | A1 * | 8/2008 | G09G 3/34 |
| WO | 2009054223 | | 4/2009 | |

* cited by examiner

IMAGE DISPLAY BASED ON MULTIPLE BRIGHTNESS INDICATORS

CROSS-REFERENCE TO RELATED APPLICATIONS

This application claims priority to U.S. Patent Provisional Application No. 61/227,652, filed 22 Jul. 2009, hereby incorporated by reference in its entirety.

TECHNICAL FIELD

The invention relates to electronic control of illumination elements for light modulating image displays. The invention has application to Liquid Crystal Displays (LCDs) and Liquid Crystal Projectors (LCPs), for example.

BACKGROUND

Light modulating image displays, such as liquid-crystal displays (LCDs) and Liquid Crystal Projectors (LCPs), produce visual images by modulating light provided by illumination element(s). Some such displays have arrays of light modulating elements. Where an image display comprises a plurality of illumination elements arranged at spaced-apart locations, individually controlling illumination elements can improve perceived image quality, for example by providing enhanced contrast.

Separately controlling illumination elements enables spatial variation of the intensity of illumination incident on a light modulator, such as an LCD. Advantageously, spatially varying the intensity of illumination provided to a light modulator may be used to enhance contrast and provide a greater dynamic range of brightness between light and dark areas of an image. Disadvantageously, differences in the illumination provided by different illumination elements may, in some circumstances, result in undesirable visible artefacts, such as haloing.

Example light modulating image displays include the DOLBY® DR37-P display, the SAMSUNG® model LN-T5281F display, and displays described in United States patent applications US 2007/0268577 A1, US 2008/0043034 A1, US 2008/0043303 A1, US 2008/0111502 A1 and US 2008/0074060 A1, all of which are hereby incorporated herein by reference for all purposes.

There is a trade-off between on the one hand, achieving enhanced contrast and dynamic range, and, on the other hand, visibility of boundaries between areas illuminated by different illumination elements. Consider an image comprising a single high luminance local brightness indication, for example a bright white star, on an otherwise low luminance background, for example dark space. Maximum contrast between the local brightness indication and the background would be achieved by controlling illumination elements to maximize the illumination provided to the area of the image that includes the high luminance brightness indication and to minimize the illumination provided to the rest of the image. But controlling the illumination elements for maximum contrast would result in haloing on the low luminance background from illumination produced by the illumination elements controlled for maximum illumination.

There is a need for an illumination element controller that provides high contrast and dynamic range, and minimally perceptible boundaries between illumination elements. There is a specific need for such a controller for providing locally controlled illumination in LCDs and LCPs.

SUMMARY

The invention has various aspects. One aspect provides displays, which may comprise computer displays, televisions, video monitors, digital cinema displays, specialized displays such as displays for medical imaging, vehicle simulators or virtual reality, advertising displays and the like, for example. Another aspect of the invention provides controllers useful for controlling light sources in displays. Another aspect provides methods for operating and controlling displays.

Further aspects of the invention and features of example embodiments of the invention are illustrated by the accompanying drawings and/or described above.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Figure 1A:
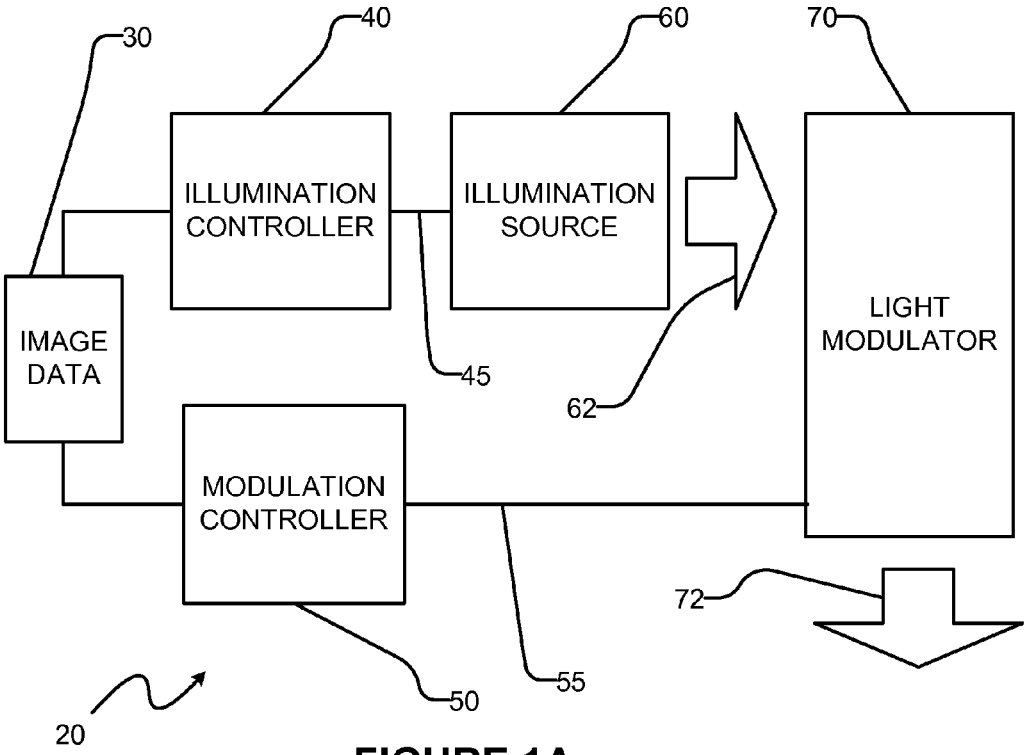
FIG. 1A is a block diagram of a light modulating image display system according to an example embodiment of the invention.

FIG. 1A shows an example image display system 20. System 20 displays an image specified by input image data 30 as a visual image embodied in output light 72. System 20 comprises illumination source controller 40 and light modulation controller 50. Illumination source controller 40 and light modulation controller 50 may comprise, for example, one or more processors, logic circuits, application specific integrated circuits (ASICs), field programmable gate arrays (FPGAs), programmable microcontrollers, general purpose computers, combinations thereof, or the like. Where controllers 40 or 50 comprise a programmable computing apparatus, they may comprise software embodying aspects of the invention. Input image data 30 is passed to illumination source controller 40, and also to light modulation controller 50. Illumination source controller 40 generates illumination control information 45 that controls illumination source 60.

Illumination source 60 comprises a plurality of illumination elements (not shown in FIG. 1A). Illumination elements may be arranged at spaced apart locations, for example in grid, diamond or honeycomb patterns. Illumination elements may be individually controllable, or controllable in groups, or both. Illumination source 60 emits light 62 according to illumination control information 45 provided by illumination source controller 40. Light 62 is incident on light modulator 70. Light modulation controller 50 generates light modulation control information 55 from input image data 30. Light modulator 70 modulates light 62 according to the light modulation control information 55 provided by light modulation controller 50. Light modulated by light modulator 70 departs light modulator 70 as output light 72. Output light 72 is perceptible as a visual image, for example, by the human eye. In some embodiments, light modulation controller 50 operates as described in PCT Publication No. WO 2006/010244 which is hereby incorporated herein by reference for all purposes. This is not mandatory however.

Figure 1B:
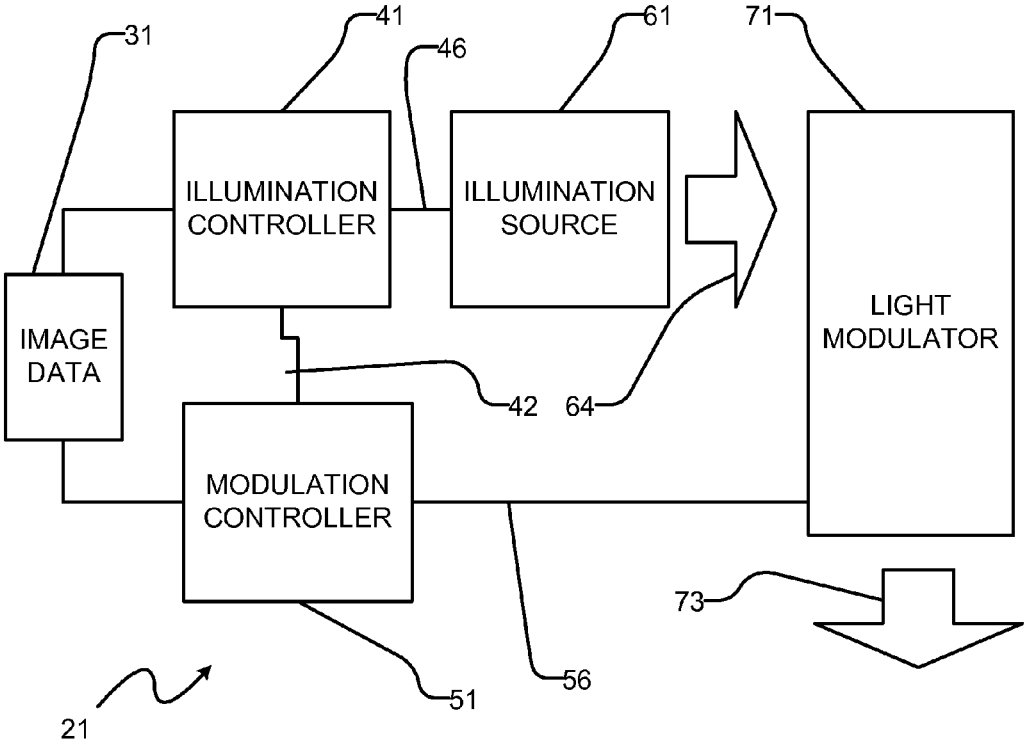
FIG. 1B is a block diagram of a light modulating image display system according to an example embodiment of the invention.

FIG. 1B shows an image display system 21 that is similar to image display system 20 of FIG. 1A. Illumination source controller 41 passes illumination information 42 to light modulation controller 51. Light modulation controller 51 uses the illumination information 42 provided by illumination source controller 41, along with image input data 31, to generate light modulation control information 56. Control information 56 may be generated, for example, as described in patent application WO2006/010244, which is incorporated herein by reference. It will be appreciated that output light 73 is a product of both illumination control information 46 generated by illumination source controller 41, by way of illumination source 61 and light 64, and of light modulation control information 56 generated by light modulation controller 51, by way of light modulator 71.

By using both input data 31 and illumination information 42 provided by illumination source controller 41, light modulation controller 51 is able to control light modulator 71 to yield enhanced image quality. The algorithms applied to obtain illumination control information 46 and light modulation control information 56 affect the fidelity of images depicted by output light 73. Some aspects of the invention are related to algorithms for controlling illumination source 61.

Figure 2A:
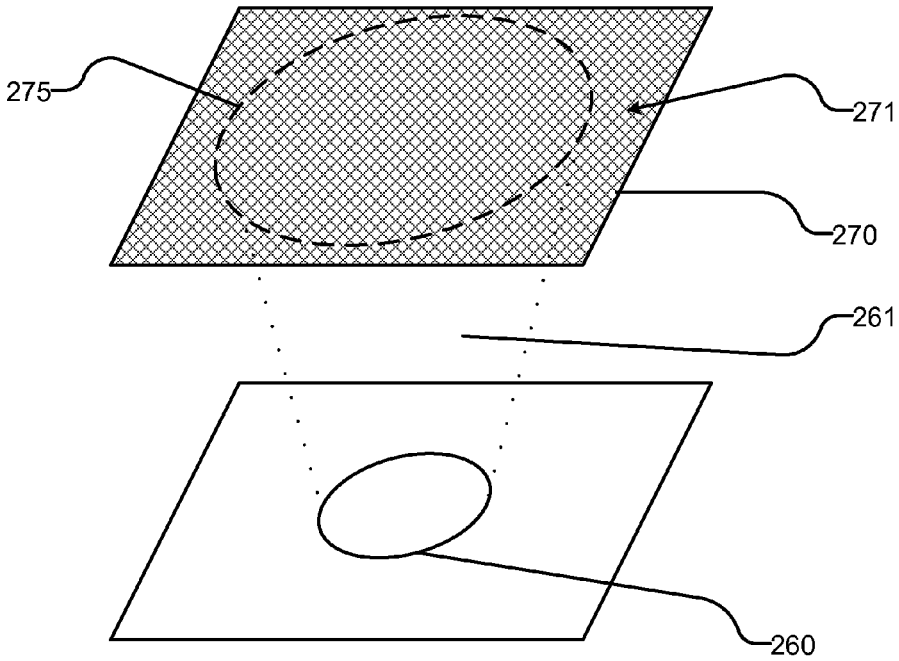
FIG. 2A is a diagram of an illumination element providing light to a light modulator.

FIG. 2A shows light 261 from an illumination element 260 incident upon an area 275 of a light modulator 270. Illumination source 60 (see FIG. 1A) may comprise a plurality of illumination elements like illumination element 260, and light 62 (see FIG. 1A) may comprise light like light 261. Light modulator 270 comprises pixels 271, which comprise controllable light modulation elements. Light modulator 71 (see FIG. 1A) may comprise pixels like pixels 271. Pixels 271 are disposed to modulate the light incident on light modulator 270 to produce output light (not shown). In FIG. 2A, pixels may appear to be transmissive light modulation elements. Displays according to different embodiments of the invention may comprise either or both of transmissive and reflective light modulation elements, for example.

Figure 2B:
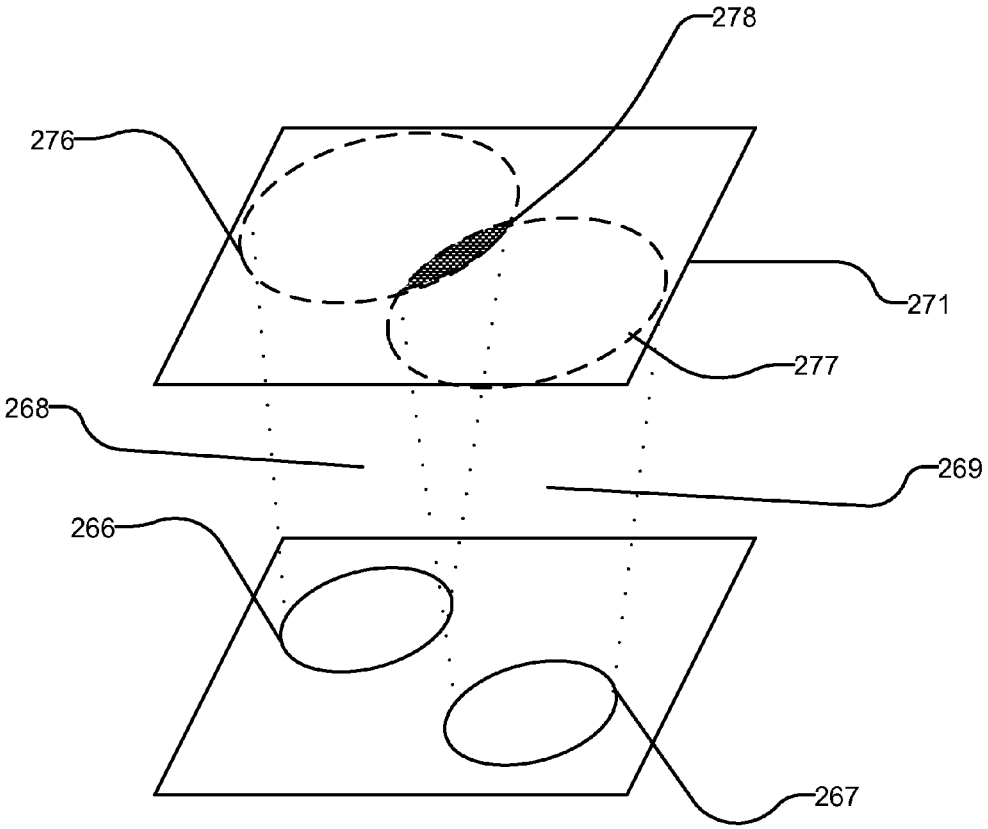
FIG. 2B is a diagram of two illumination elements providing light to a light modulator.

FIG. 2B shows light 268 and 269 from illumination elements 266 and 267, respectively, incident onto areas 276 and 277, respectively, of light modulator 271. In some embodiments, a plurality of illumination elements are arranged in an illumination source such that light provided by the plurality of illumination elements illuminates a continuous area of a light modulator. In some such arrangements this causes light from a plurality of different illumination elements to illuminate the same area of the light modulator in an overlapping fashion. In FIG. 2B, area 278 is such an area. Some embodiments of the invention take such overlaps of illumination into account in the control of illumination elements.

Figure 3:
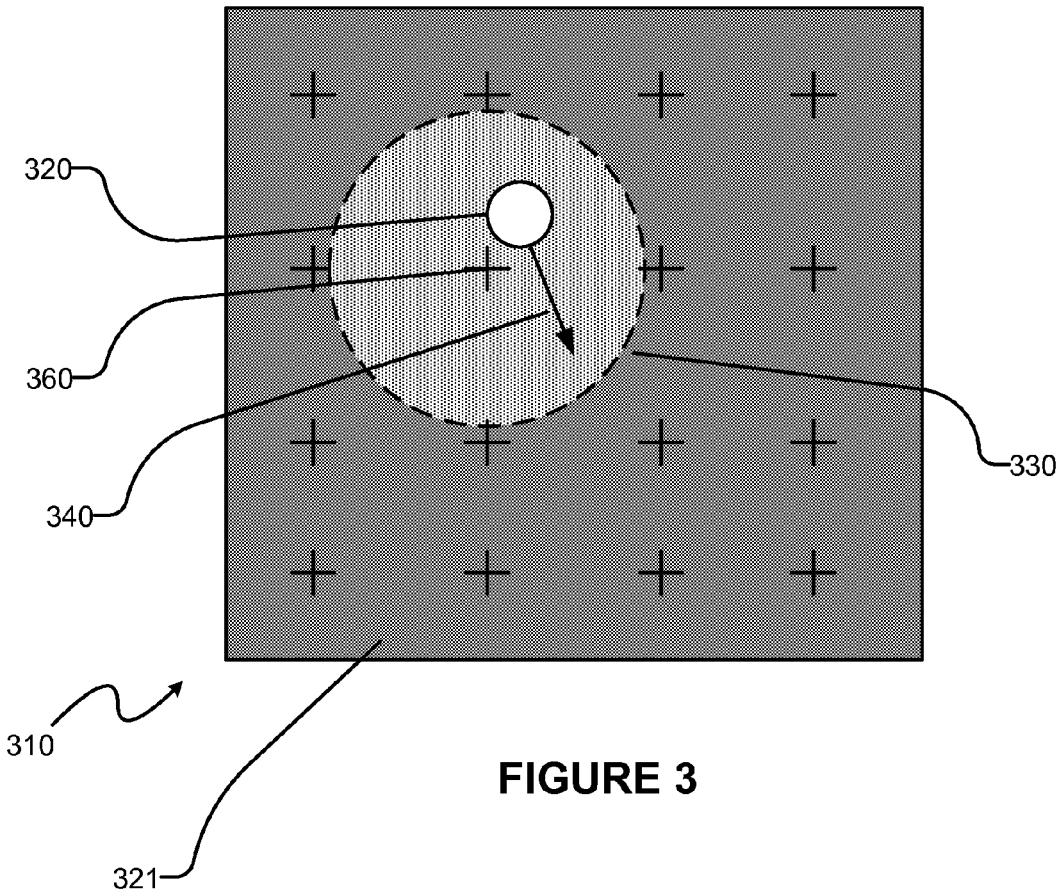
FIG. 3 is a diagram of a high brightness feature on a light modulating image display.

FIG. 3 shows a light modulating image display 310, on which is shown an image comprising a bright white spot 320 on a dark background 321. Display 310 comprises illumination elements, which are represented by crosses in FIG. 3. Bright spot 320 results from a light modulator of display 310 allowing light from illumination element 360 to pass to a viewing location. Because the light modulator of display 310 cannot entirely block light from illumination element 360, a halo 330 about bright spot 320 may be observable. If bright spot 320 moves along the trajectory indicated by arrow 340, for example as might happen if display 310 were displaying video, illumination elements along that trajectory are controlled to emit the light required to show bright spot 320. Illumination element 360 would be dimmed as bright spot 320 is moved away from the area in which light from illumination element 360 is primarily concentrated.

Because illumination elements are located at spaced apart locations, movement of bright spot 320 could result in a perceptible halo jerkily "walking" along with bright spot 320. Halo 330 may be especially noticeable if spot 320 is both very bright and small relative to the area illuminated by individual elements 360. To reduce the appearance of halo 330, illumination element 360 may be controlled to provide less intense illumination than the image data for bright spot 320 would otherwise indicate. In most circumstances, controlling illumination element 360 based on the average intensity values for the area of the light modulator illuminated by illumination element 360 provides acceptable contrast. However, controlling illumination element 360 this way when the area of bright spot 320 is small relative to the area illuminated by illumination element 360 (i.e., the area of halo 330) could cause bright spot 320 to appear dimmer than desired.

Embodiments control illumination elements in a display in a manner that can reduce perceptible haloing or similar artefacts. The control may involve determining two or more indications of image brightness (or intensity) for areas of an image and controlling a light source according to combinations of these indications. An image brightness indication is a measure of a property of the brightness of a set of image elements that make up an area of an image. In some embodiments, such properties comprise a central tendency of brightness (or intensity) and an upper extreme indication of brightness (or intensity) for an area. Some examples of such embodiments are described below.

Figure 5:
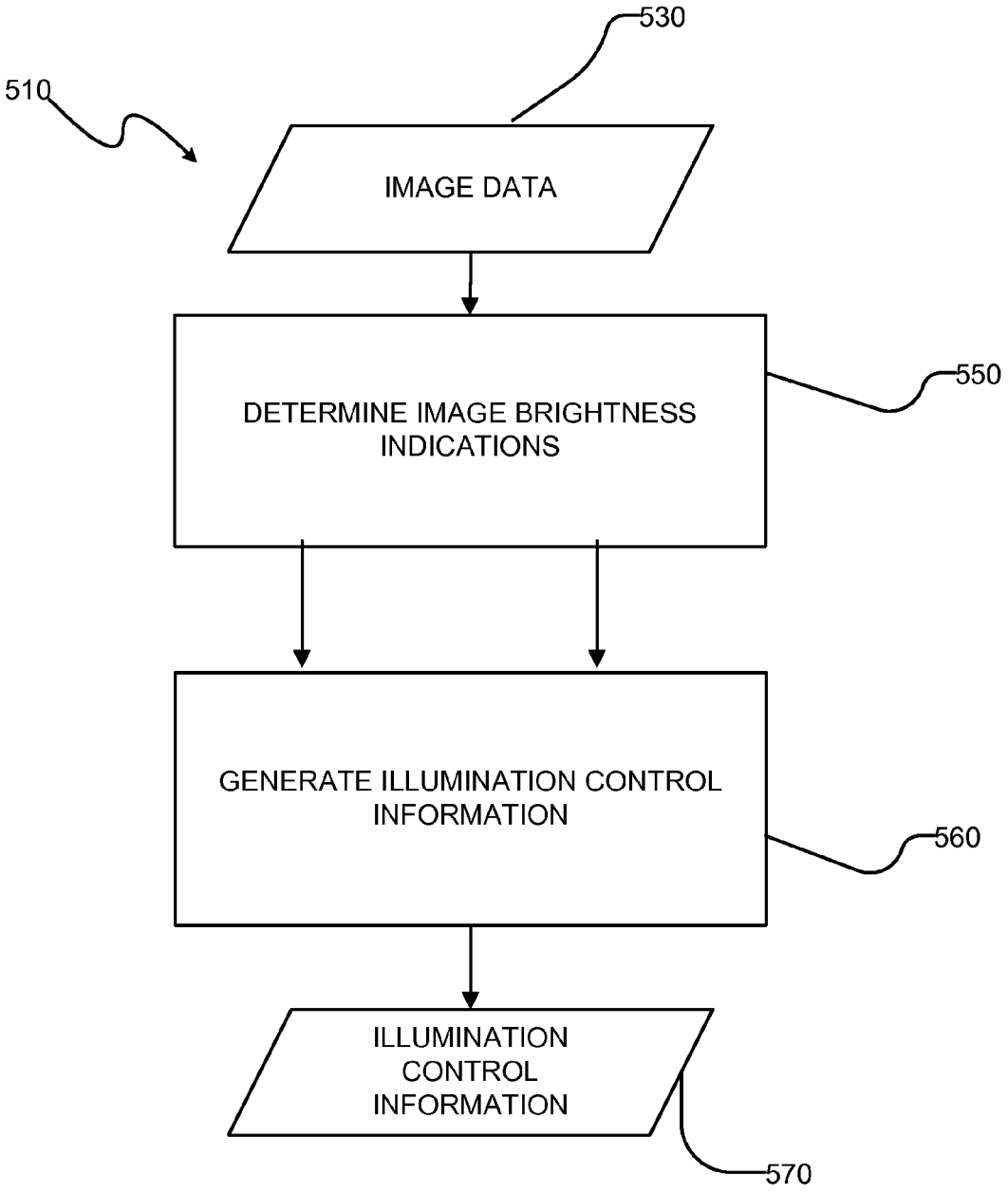
FIG. 5 is a flow chart of a method according to an example embodiment of the invention.

FIG. 5 shows a flow chart illustrating a method 510 for generating output illumination control data from input image data 530 according to an example embodiment of the invention. Method 510 may be executed by a display controller. In some embodiments the image data is video data and method 510 is repeated for each frame of the video data or every few frames, for example. In some embodiments method 510 can provide dynamic control of illumination elements.

At step 550, two or more image brightness indications are determined from the input image data 530. In some embodiments, luminance, relative luminance, luma or other like properties of image elements are used in determining image brightness indications. Image brightness may be specified separately for different colors in some embodiments or may be specified for the image generally. At step 560, illumination control information 570 is generated from image brightness indications determined at step 550. Step 560 may comprise combining and/or transforming image brightness indications.

In embodiments, image brightness indications may be determined, for example, from image data associated with image elements. Pixels are an example of image elements. Since in some embodiments image data may specify values for more (even many more) image elements as compared to the number of available illumination elements, in some embodiments, image brightness indications may be determined from downsampled image data. Image brightness indications may also be determined from transformed image data, such as, for example, subsampled image data, filtered image data, scaled image data, weighted image data, combinations thereof, or the like.

In some embodiments an image brightness indication comprises a statistic of the brightness levels specified for a set of image elements, such as pixels. Pixel data may specified in various color spaces where a component of the color space represents brightness. For example, in the YUV, Y'UV, $YC_BC_R$, $Y'C_BC_R$, $YP_BP_R$, HSL, HSV and L*a*b colorspaces the components Y (luminance), Y' (luma), L (lightness) and V (value) represent brightness. An image brightness indication may comprise a statistic of the brightness components of a set of pixel data. Pixel data may also be specified in other color spaces, and brightness components determined from the representations of pixels in these color spaces. For instance, a pixel data may be specified in the RGB color space, and brightness components may be formed as a weighted sum of RGB components. Since image brightness indications may be determined from transformed image data, it is similarly possible that image brightness indications may be determined from transformed brightness components.

Figure 4A:
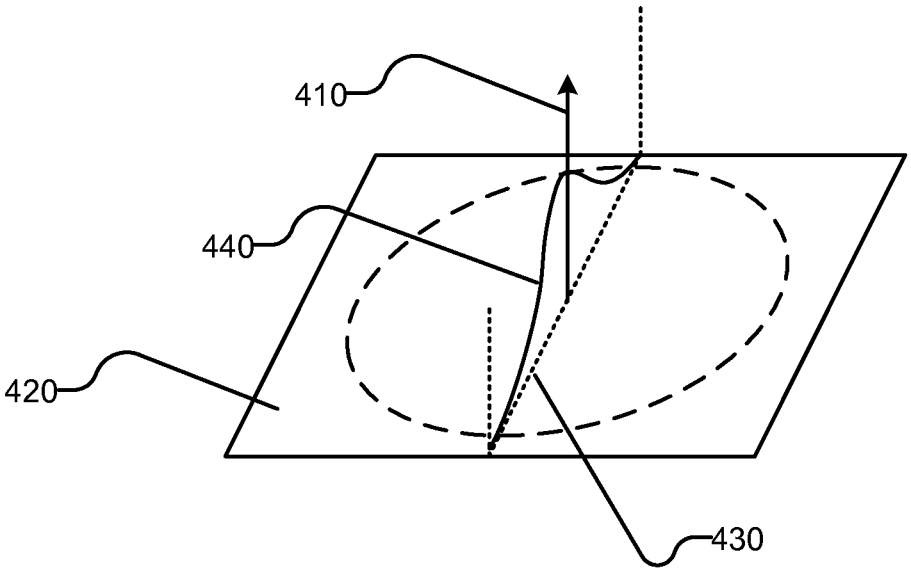
FIG. 4A is a diagram of a profile of the intensity of light from an illumination element at a surface.
Figure 4B:
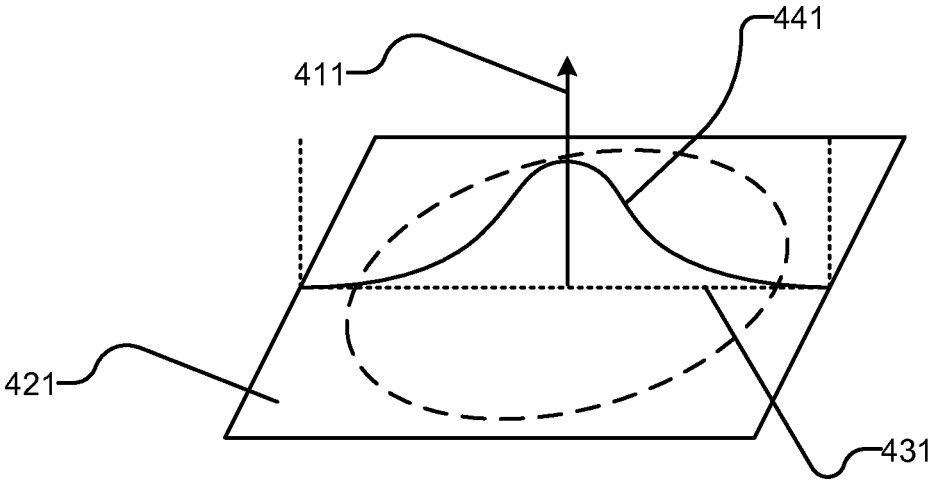
FIG. 4B is a diagram of a profile of the intensity of light from an illumination element at a surface.

Embodiments may take into account spatial variations in intensity of light from illumination elements in determining image brightness indications. Most illumination elements emit light which varies in intensity according to a point spread function. FIGS. 4A and 4B illustrate how the intensity of light incident on a surface may vary across the surface. In FIG. 4A, axis 410 is normal to surface 420, line 430 is in surface 420, and curve 440 is in a plane defined by axis 410 and line 430. The intensity of light incident on surface 420 at a point along line 430 is represented by the point on curve 440 intersected by the line normal to surface 430 that extends from the point along line 430. Similarly, FIG. 4B shows the intensity of light incident at surface 421, and curve 441 represents the intensity of light incident at surface 421 at points along line 431.

It is thought to be advantageous in some embodiments for point spread functions to be generally Gaussian and to overlap, such that a set of illumination elements disposed in a plane can be operated to provide illumination that combines to be generally uniform in intensity over planes parallel to and distant from the plane in which the illumination elements are disposed. Accounting for the point spread function of illumination elements in the control of illumination elements can improve image quality. Some embodiments of the invention take point spread functions of illumination elements into account when determining image brightness indications. In some embodiments, image brightness indications are determined from sets of image elements normalized with respect to the point spread functions of illumination sources that provide light to display the image elements.

Figure 6:
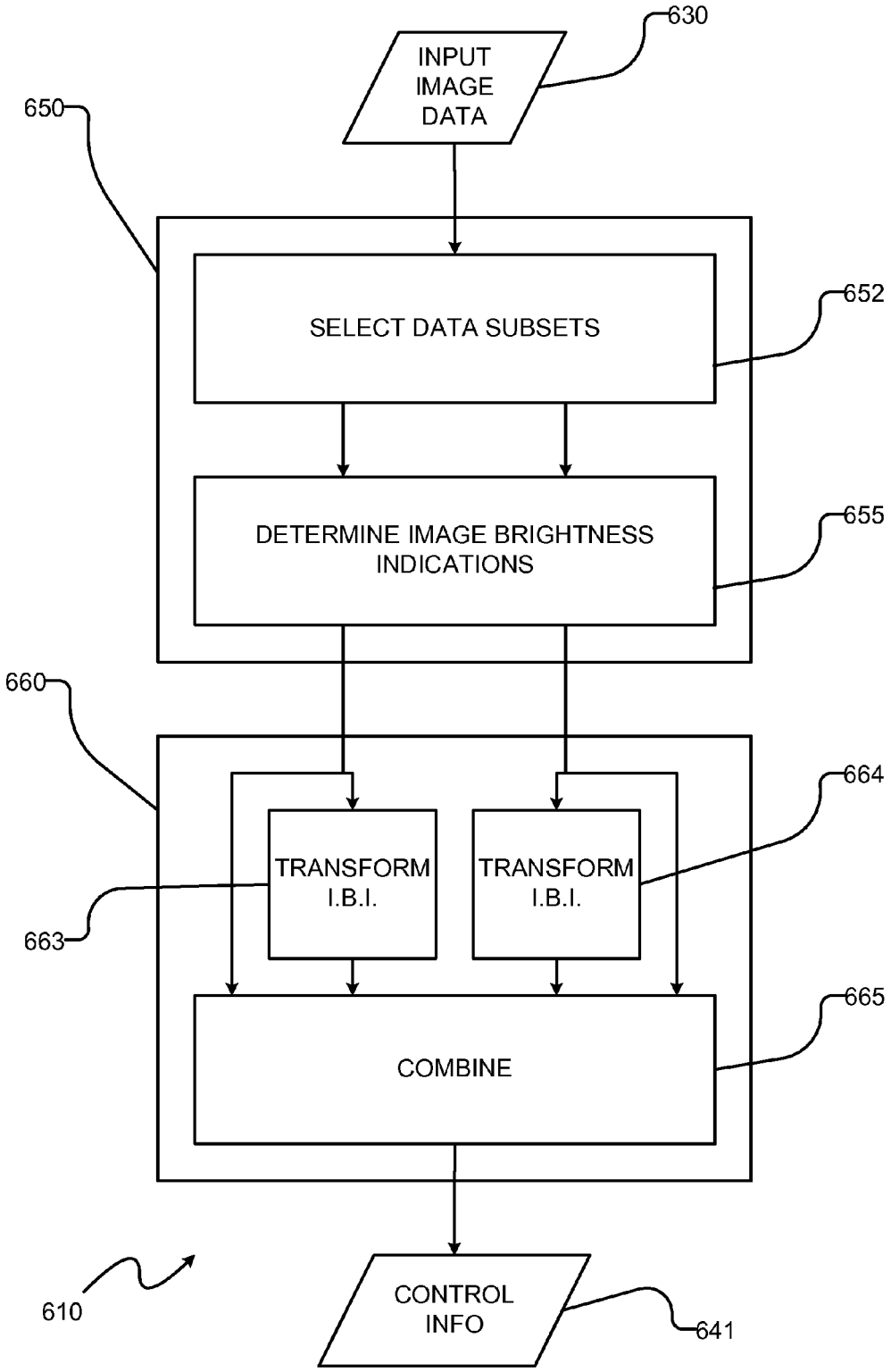
FIG. 6 is a flow chart of a method according to an example embodiment of the invention.

FIG. 6 shows a flowchart representative of a method 610 for generating illumination control information from input image data according to an example embodiment of the invention. To more clearly explain the operation of method 610, the generation of illumination control information for only a single illumination element is described. The same method may be applied serially or in parallel to generate illumination control information for a plurality of illumination elements.

Image brightness indication determination step 650 comprises steps 652 and 655. Step 652 selects one or more subsets of image data 630. The subset(s) of image data 630 are selected to correspond to regions of image elements to be illuminated at least in part by an illumination element to be controlled, at least in part, by illumination control information 641. Regions may be conveniently square or rectangular, so as correspond to regular arrangements of image data, such as, for example, square or rectangular blocks of data. However, regions need not be square or rectangular, and need not correspond to regular arrangements of image data. A region may be defined so as to reflect the point spread function of an illumination element. For example, a region may comprise image elements that can be provided at least a threshold fraction of the light emitted by an illumination element.

Figure 8:
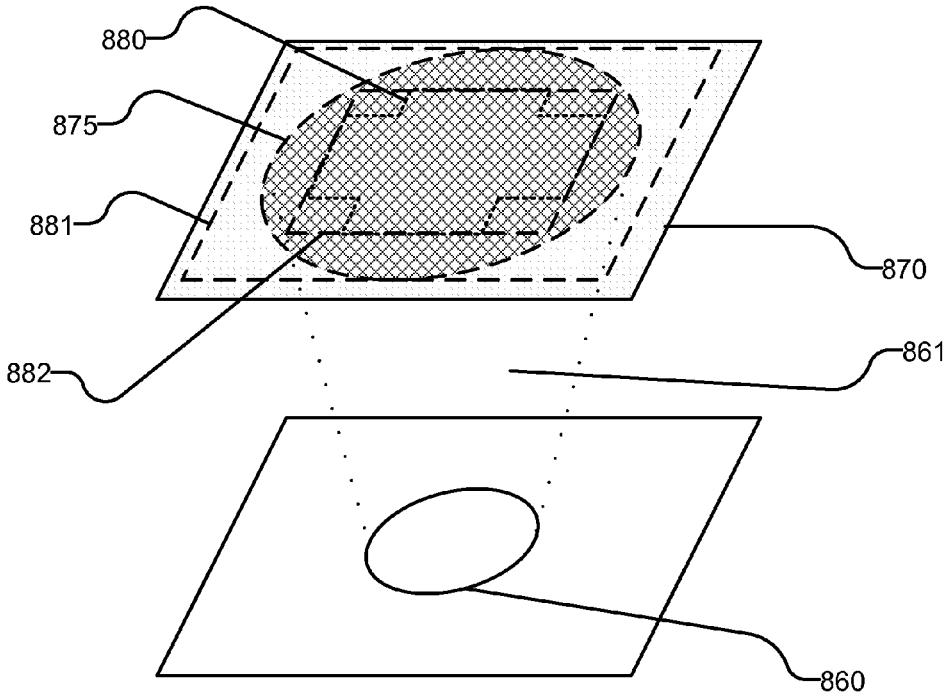
FIG. 8 is a diagram of an illumination element providing light to a light modulator.

FIG. 8 shows illumination element 860 projecting light 861 onto light modulator 870. Illumination element 860 projects light in a circular pattern. Light 861 may have a point spread function according to curves 440 and 441 of FIG. 4. Circular area 875 represents an area of light modulator 870 that can be provided light of at least a threshold intensity from illumination element 860. Image elements of an image are displayed on regions 880, 881 and 882 of light modulator 870. Regions 880, 881 and 882 correspond to subsets of image data representing the image elements of the image displayed on light modulator 870.

Region 880 comprises a cross shaped region within generally circular area 875. Region 881 comprises a square region that encompasses generally circular area 875. Region 882 comprises a square region within generally circular area 875. In some embodiments, illumination elements are controlled, at least in part, by illumination control information derived from subsets of image data corresponding to regions like regions 880, 881 and 882. For example, in an example embodiment according to FIG. 6, image data subsets corresponding to regions like regions 680 and 682 may be selected in step 652.

Figure 9:
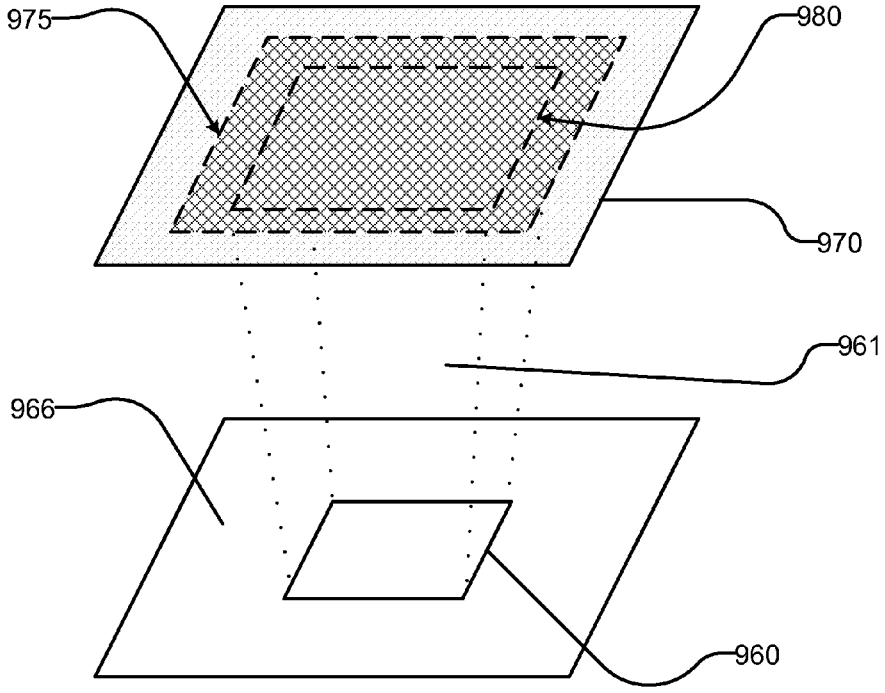
FIG. 9 is a diagram of an illumination element providing light to a light modulator.

FIG. 9 shows an illumination element 960 which projects light 961 onto a light modulator 970. Illumination element 960 projects light in a square pattern. The point spread function of light 961 may be other than radial. Square area 975 represents an area of light modulator 970 that can be provided light of at least a threshold intensity from illumination element 960. Image elements of an image are displayed on region 980 of light modulator 970. Region 980 corresponds to a subset of the image data representing these image elements of the image displayed on light modulator 970. In some embodiments, illumination elements are controlled, at least in part, by illumination control information derived from a subset of image data corresponding to a region like region 980.

It is apparent from FIGS. 8 and 9 that regions corresponding to image data subsets may be larger or smaller than an area effectively illuminated by an associated illumination element, and may have arbitrary geometry.

Returning to method 610 of FIG. 6, in step 655 one or more image brightness indications are determined from the two or more image data subsets selected at step 652. In some embodiments, a central tendency brightness indication is determined in step 655. A central tendency brightness indication is an indication of the overall intensity of illumination specified for an area of an image. The central tendency brightness indicator may indicate the light intensity required to be provided to a light modulator to make the bulk of a set of image elements to appear as specified by image data.

A central tendency brightness indication may comprise, for example, a central tendency statistic of the brightness of a set of image elements, such as pixels. For example, a central tendency brightness indication may comprise, for a set of image elements, an average such as an arithmetic mean, a median luminance, or a quantile of the brightness of the image elements. Other example central tendency indications of image brightness may comprise, for example, for a set of image elements, a truncated discretized mode, a truncated arithmetic mean, a geometric mean, a truncated geometric mean, a discretized mean, or an arithmetic or geometric weighted mean of the brightness of the image elements. For instance, an arithmetic weighted mean brightness may comprise an arithmetic mean calculated by weighting the brightness components of each of a set of pixel data according to the relative illumination provided by an LED to each of the pixels corresponding to the pixel data (i.e., according to the point-spread function of the LED at the location of each pixel).

In some embodiments, a central tendency brightness indication for a set of image elements comprises a measure of the number of image elements whose brightness is greater than a threshold value. The measure may comprise, for example, a number or a percentage. In other embodiments, a central tendency indication comprises a sum of numerical representations of the brightnesses of image elements, for example, a sum of the brightness components of image data specifying the image elements.

It can be understood that central tendency indications are often functions of the values of all or most pixels or other image elements in an area under consideration. This is not mandatory however.

In some embodiments, an upper extreme brightness indication is determined in step 655. An upper extreme brightness indication is an indication of the intensity of illumination required to be provided to a light modulator to make the brightest member or members of a set of image elements appear as specified by image data.

Figure 10A:
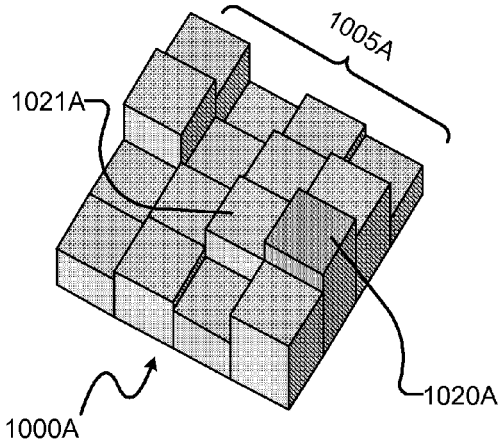
FIG. 10A is a three-dimensional bar chart, the bars of which represent the brightness of each of a set of image elements.

An upper extreme brightness indication may comprise a maximum statistic of the brightness of a set of image elements, such as, for example, pixels. FIG. 10A shows a three-dimensional bar chart 1000A whose bars 1005A represent the brightness of each of a set of sixteen image elements, which make up a portion of an image. Bars 1005A may, for example, be representative of the brightness components of pixel data. The image element corresponding to bar 1020A has the greatest brightness of the set of image elements. According to some embodiments, the upper extreme brightness indication for the image made up of the set of image elements whose brightness is represented by bars 1005A is the brightness represented by bar 1020A.

In some embodiments, an upper extreme brightness indication may comprise, for example, for a set of n image elements, the n−1 order statistic for image element brightness (i.e., the brightness of the image element having the second greatest brightness among the set of image elements). In other embodiments, an upper extreme brightness indication or may comprise, for a set of n image elements, the n−m order statistic for image element brightness, for any suitable m, e.g. $m>n/4$.

In some embodiments, an upper extreme brightness indication may comprise a truncated maximum statistic. For example, for a set of n image elements, an upper extreme brightness indication may comprise a truncated maximum statistic, for instance, the maximum statistic of the n−m least bright elements, for some suitable m such as $m<n/4$. In some embodiments, an upper extreme brightness indication may comprise a minimum frequency maximum statistic. For example, for a set of image elements, an upper extreme brightness indication may comprise the maximum brightness of all image elements whose brightness equals the brightness of at least two other image elements. In other example embodiments, image elements are binned according to their brightness, and the upper extreme brightness indication is a value typifying the maximum brightness bin that contains at least a minimum number of image elements.

In some embodiments, an upper extreme brightness indication may be determined from the scaled brightness of a set of image elements. For example, an upper extreme brightness indication may comprise the maximum of a set of values obtained by scaling the brightness component of each of a set of pixel data according to the relative illumination provided by an LED to each of the pixels corresponding to the pixel data (i.e., according to the point-spread function of the LED at the location of each pixel).

Figure 10B:
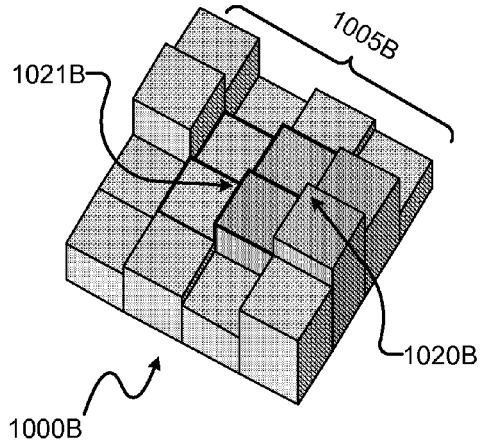
FIG. 10B is a three-dimensional bar chart, the bars of which represent the brightness of each of a set of image elements.
Figure 10C:
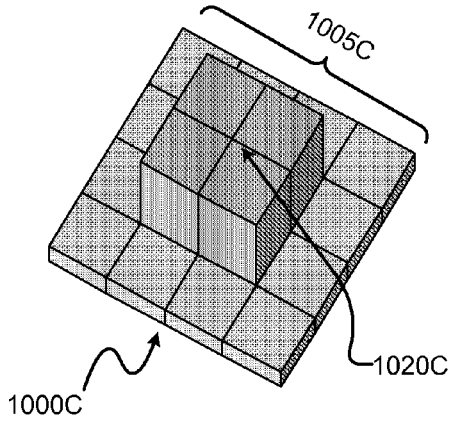
FIG. 10C is a three-dimensional bar chart, the bars of which represent the brightness of each of a set of image elements.
Figure 10D:
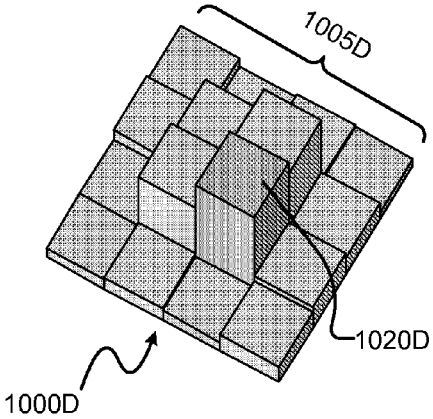
FIG. 10D is a three-dimensional bar chart, the bars of which represent the brightness of each of a set of image elements.

FIG. 10D shows a three-dimensional bar chart 1000D whose bars 1005D represent the scaled brightness of a set of sixteen image elements. Bars 1005D may, for example, be representative of scaled brightness components of pixel data, or may be representative of brightness components of scaled pixel data. Bars 1005D of FIG. 10A, which represent scaled brightness, correspond to bars 1005A of FIG. 10A, which represent brightness, scaled according to scaling values represented by bars 1005C of three-dimensional bar chart 1000C of FIG. 10C. The scaling values represented by bars 1005C may reflect a point spread function, for example. The image element corresponding to bar 1020D has the greatest scaled brightness of the set of image elements. In some embodiments, the upper extreme brightness indication for the image made up of the set of image elements whose brightness is represented by bars 1005A is the brightness represented by bar 1020D. In other embodiments, the upper extreme brightness indication for the image made up of the set of image elements whose brightness is represented by bars 1005A is the brightness represented by bar 1020A (i.e., the unscaled brightness of the image element having the greatest scaled brightness).

An upper extreme brightness indication may comprise, for example, for a set of image elements of an image, a value typifying an upper extreme brightness sub-set of image elements. Identification of an upper extreme brightness sub-set of image elements depends on the definition of the candidate sub-sets and the criterion or criteria for selecting an upper extreme brightness sub-set from a set of candidate sub-sets. For example, an upper extreme brightness indication may comprise the mean brightness of a sub-set of four pixels arranged in a 2×2 quadrangle having the greatest mean brightness of all such sub-sets in an image (i.e., the candidate sub-sets). In this example, the set of candidate sub-sets is the set of groups of four pixels arranged in 2×2 quadrangles, the selection criteria is maximum mean subset brightness, and the upper extreme brightness sub-set is typified by its mean brightness. It is not necessary that the selection criteria for an upper extreme brightness sub-set be the same as the way in which the upper extreme brightness sub-set is typified.

FIG. 10B shows a three-dimensional bar chart 1000B whose bars 1005B represent the brightness of a set of sixteen image elements, which make up a portion of an image. The image elements corresponding to bars 1020B comprise the sub-set of four pixels arranged in a 2×2 quadrangle having the greatest mean brightness of all such sub-sets among the set of sixteen image elements whose brightness is represented by bars 1005B. In some embodiments, the upper extreme brightness indication for the image made up of the set of image elements whose brightness is represented by bars 1005B is the mean of the brightness represented by bars 1020B (the bars in FIG. 10B drawn with heavy fill).

In some embodiments, a maximum brightness sub-set may comprise a sub-set of image elements having the greatest number of image elements with brightness above a threshold among all such sub-sets. For instance, a maximum brightness sub-set may comprise the sub-set of sixteen pixels arranged in a 4×4 quadrangle having the greatest number of pixels with a relative luminance of at least 80.

It will be appreciated for an upper extreme brightness indication comprising a value typifying an upper extreme brightness sub-set of image elements, the candidate sub-sets of image elements may be defined according to any suitable geometry and dimension, and need not comprise only contiguous image elements. It will be further appreciated that the criterion or criteria for selecting an upper extreme brightness sub-set from a set of candidate sub-sets may comprise selecting a sub-set according to a position in a ranking of image brightness indications of the sub-sets.

In some embodiments, candidate sub-sets of image elements may comprise scaled image elements. For example, candidate sub-sets may comprise values obtained by scaling the brightness component of each of a set of pixel data according to the relative illumination provided by an LED to each of the pixels corresponding to the pixel data (i.e., according to the point-spread function of the LED at the location of each pixel).

Figure 10E:
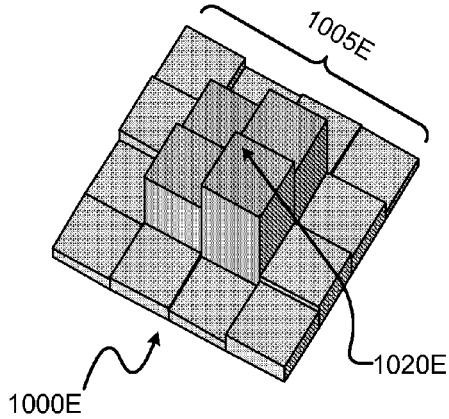
FIG. 10E is a three-dimensional bar chart, the bars of which represent the brightness of each of a set of image elements.

FIG. 10E shows a three-dimensional bar chart 1000E whose bars 1005E represent the scaled brightness of a set of sixteen image elements. Bars 1005E could, for example, be representative of scaled brightness components of pixel data, or representative of brightness components of scaled pixel data. Bars 1005E of FIG. 10E, which represent scaled brightness, correspond to bars 1005B of FIG. 10B, which represent brightness, scaled according to scaling values represented by bars 1005C of three-dimensional bar chart 1000C of FIG. 10C. The image elements corresponding to bars 1020E comprise the sub-set of four pixels arranged in a 2×2 quadrangle having the greatest mean brightness of all such sub-sets among the set of sixteen image elements whose brightness is represented by bars 1005E. In some embodiments, the upper extreme brightness indication for the image made up of the set of image elements represented by bars 1005B is the mean brightness of the image elements corresponding to bars 1020E. In other embodiments, the upper extreme brightness indication for the image made up of the set of image elements whose brightness is represented by bars 1005B is the mean brightness of the image elements represented by bars 1021B (the bars in FIG. 10B drawn with a heavy border), i.e., the mean unscaled brightness of the subset of image element having the mean scaled brightness.

A value typifying an upper extreme brightness sub-set may comprise a value indicative of the brightness any element of the sub-set. A value typifying the maximum brightness sub-set may comprise, for example, a central tendency brightness indication of the sub-set. A value typifying an upper extreme brightness sub-set may comprise the brightness of the least bright image element of the sub-set.

In some embodiments, a dispersion indication of image brightness is determined in step 655. A dispersion indication of image brightness is an indication of variability or spread of intensities of light required to be provided to a light modulator to make the bulk of a set of image elements appear as specified by image data. A dispersion indication of image brightness may comprise a statistical measure of dispersion or variability of the brightness of a set of image elements. For example, a dispersion indication of image brightness may comprise a range, a variance, a standard deviation, an interquartile range, /wiki/Range_(statistics) a mean difference, a median absolute deviation, an average absolute deviation, or the like. A dispersion indication of image brightness may also comprise a dimensionless statistical measure of dispersion or variability of the brightness of a set of image elements, such as, for example, a coefficient of variation, a quartile coefficient of dispersio, a relative mean difference, or the like.

Output generation step 660 comprises steps 663, 664 and 666, which together combine at least some of the image brightness indications determined in step 650. In steps 663 and 664 image brightness indications determined at step 655 are transformed. The transformations of steps of 663 and 664 may comprise operations on a single image brightness indication, or a combination of a plurality of image brightness indications. Steps 663 and 664 may comprise operations on the same set or different sets of image brightness indications. In some embodiments, steps 663 and 664 may be combined into a single step.

In some embodiments, transformations of image brightness indications comprise computing mathematical functions. In some embodiments, transformations of image brightness indications comprise obtaining a value or values from one or more look-up tables using a key or keys. Such a key may comprise, for example, an image brightness indication or the result of a combination image brightness indications. In some embodiments, transformations of image brightness comprise using combinations of computable functions and values obtained from look-up tables. For instance, a dispersion indication of image brightness (e.g., variance) may be used as a key to look-up a scaling or weighting value, which is used in a computable function to transform an image brightness indication.

Step 666 combines the outputs of the transformations performed in steps 663 and 664 and the image brightness indications determined in step 655 to create output illumination control information 641. Output illumination control information 641 may be used to control an illumination element configured to provide illumination to at least part of the spatial region(s) of the image that correspond(s) to the subset(s) of image data selected in step 652.

Figure 7:
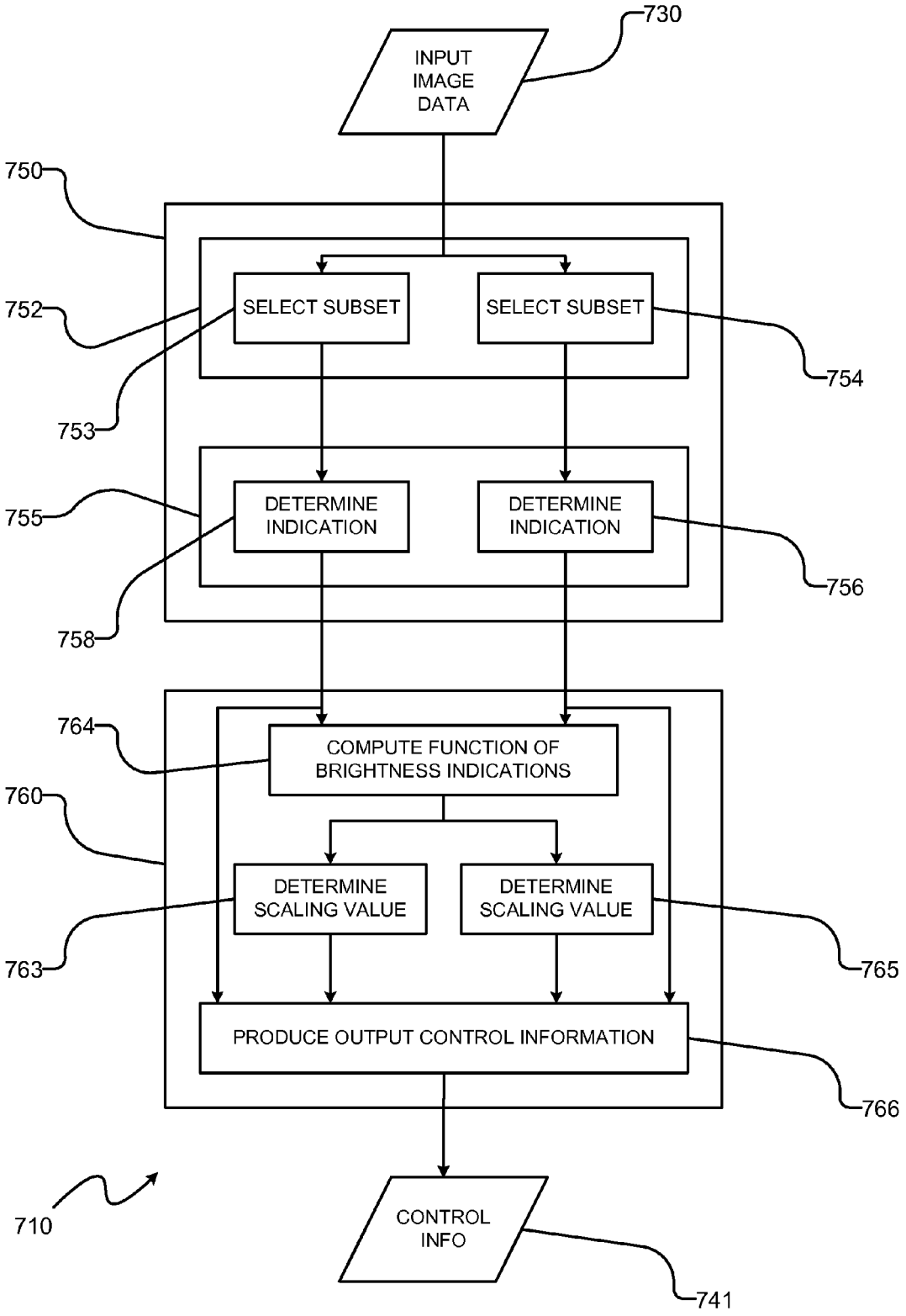
FIG. 7 is a flow chart of a method according to an example embodiment of the invention.

FIG. 7 shows a method 710 for generating output illumination control information from input image data. To more clearly explain the operation, the generation of illumination control information for only a single illumination element is described. It will be understood that the same method may be applied serially or in parallel to generate illumination control information for a plurality of illumination elements.

Input image data 730 is used at image processing step 750. Step 750 comprises data selection step 752 and image brightness indication determination step 755. Data selection step 752 comprises steps 753 and 754, which may be performed serially or in parallel. In each of steps 753 and 754, a subset of input image data 730 is selected. The data in the subsets is spatially related in that it correspond to image elements of an image to be illuminated, at least in part, by an illumination element to be controlled, at least in part, by illumination control information 741.

The subsets of input image data generated at steps 753 and 754 are passed to image brightness indication determination step 755. Step 755 comprises image brightness indication determination sub-steps 756 and 758, which may be performed serially or in parallel. Image brightness indication determination sub-step 758 determines an image brightness indication from the image data subset generated in step 754. Image brightness indication determination sub-step 758 determines an image brightness indication from the image data subset generated in step 753. In some embodiments, image brightness indications may be determined from a single image data subset, or identical image data subsets, and in these embodiments only one image data subset may be used in step 755.

It will be appreciated that different image brightness indications may be determined from different subsets of input image data. For example, in step 756 a central tendency brightness indication could be determined from a first image data subset generated in step 754, and in step 758 an upper extreme brightness indication could be determined from a second image data subset generated in step 753.

The image brightness indications determined in steps 758 and 756 are used in output generation step 760. Step 760 comprises steps 764, 765, 763 and 766. Step 764 comprises computing a function of the image brightness indications determined in steps 756 and 758. In some embodiments, step 764 comprises computing a difference of an upper extreme brightness indication and a central tendency brightness indication.

In some embodiments, steps 763 and 765 may each comprise computing a scaling or weighting value according to a function of an output determined by step 764. In other embodiments, steps 763 and 765 may, for example, comprise using the output of step 764 as a key obtain a weighting value from a look-up table. In some embodiments weighting values or scaling values may be normalized, such that the results of steps 763 and 765 sum to a constant value. In some embodiments, weighting or scaling values may be subject to minimums. For example, the weighting value intended to be applied in step 766 to a central tendency brightness indication may be at least a certain value for all possible inputs of image brightness indications.

Digressing to particular examples of scaling or weighting values, FIGS. 11A, 11B, 11C and 11D show curves that define relationships between an input and two outputs. Relationships of the sort defined by the curves shown in FIGS. 11A, 11B, 11C and 11D are suitable for use in embodiments of the invention for transforming image brightness indications, such as, for example, upper extreme brightness indications and central tendency brightness indications. For example, the relationships may be used in steps 763 and 765 of method 710, the input variables corresponding to the result of step 764 and the output variables corresponding to scaling values for central tendency brightness indications and upper extreme brightness indications. In apparatus and system embodiments, the relationships illustrated by the curves shown in FIGS. 11A, 11B, 11C and 11D may be embodied in computable functions or lookup tables, for example.

In some embodiments, the input variables depicted in FIGS. 11A, 11B, 11C and 11D may correspond to a difference between a central tendency brightness indication and an upper extreme brightness indication, or to a dispersion indication of image brightness, for example, variance. In some embodiments, the decreasing output variables may correspond to weighting or scaling values applied to an upper extreme brightness indication. In some embodiments, the increasing output variables may correspond to weighting or scaling values applied to a central tendency brightness indication.

Figure 11A:
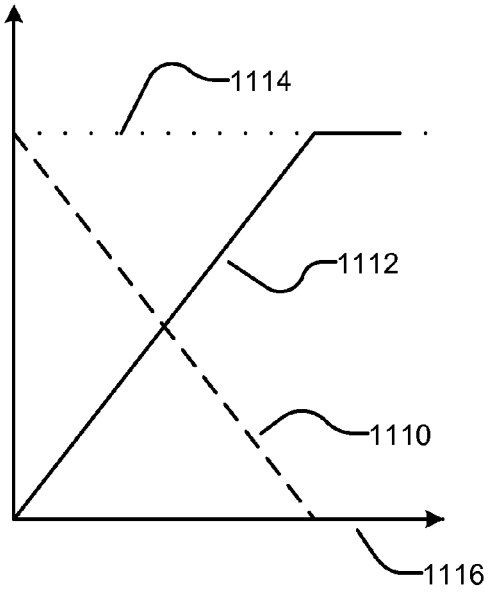
FIG. 11A is a graph of relationships between an input and two outputs.

FIG. 11A shows complementary curves 1110 and 1112. Curve 1110 is monotonically decreasing. Curve 1112 is monotonically increasing. As can be seen, for any input value along axis 1116, the corresponding output values along curves 1110 and 1112 are normalized such that they add to the constant shown by line 1114.

Figure 11B:
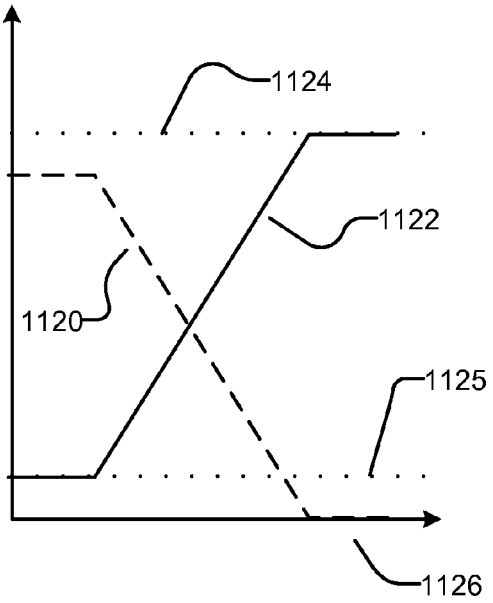
FIG. 11B is a graph of relationships between an input and two outputs.

FIG. 11B shows complementary curves 1120 and 1122. Curve 1120 is monotonically decreasing. Curve 1122 is monotonically increasing. Curve 1122 is subject to a minimum bound indicated by line 1125. As can be seen, the output values along curves 1120 and 1122 are normalized such that they add to the constant shown by line 1124.

Figure 11C:
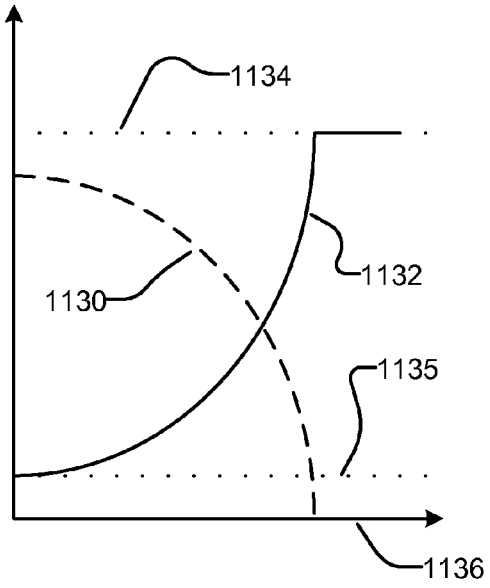
FIG. 11C is a graph of relationships between an input and two outputs.

FIG. 11C shows complementary non-linear curves 1130 and 1132. Curve 1130 is monotonically decreasing. Curve 1132 is monotonically increasing. Curve 1132 is bounded at its minimum by the value show by line 1135. As can be seen, the output values along curves 1130 and 1132 are normalized in that they add to the constant shown by line 1134.

Figure 11D:
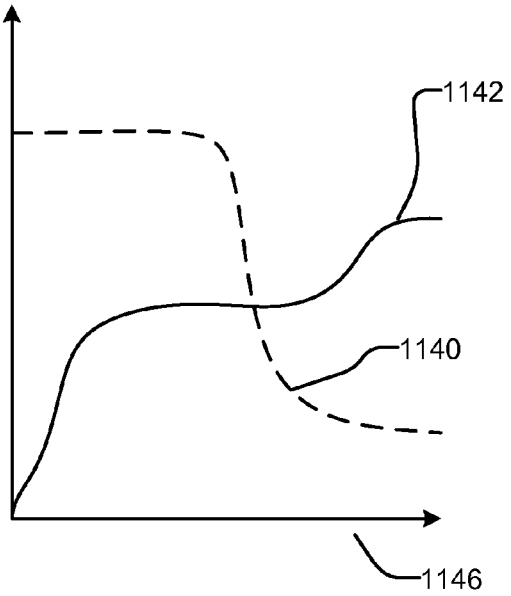
FIG. 11D is a graph of relationships between an input and two outputs.

FIG. 11D shows curves 1140 and 1142, which correspond to the functions of an input, the range of which is depicted along horizontal axis 1146. Curves 1140 and 1142 are not complementary and non-linear.

Returning to method 710 of FIG. 7, step 766 comprises combining the results of steps 763 and 765 to produce output control information 741. Output control information 741 may be used to control an illumination element configured to provide illumination to at least part of the spatial region(s) of the image that correspond(s) to the subset(s) of image data. In some embodiments, step 766 may comprise combining image brightness indications and scaling or weighting values. For example, step 766 may comprise adding the product of the results generated in steps 765 and 763 to the product of the results generated in steps 758 and 755. In some embodiments. In some embodiments, step 766 comprises summing the product of a first weighting value and a central tendency brightness indication, and the product of a second weighting value and an upper extreme indication of maximum brightness. It will be appreciated that other embodiments may comprise different combination functions, and that these other combination functions may comprise operations on greater or fewer image brightness indications and may comprise higher order terms and constant terms.

Figure 12:
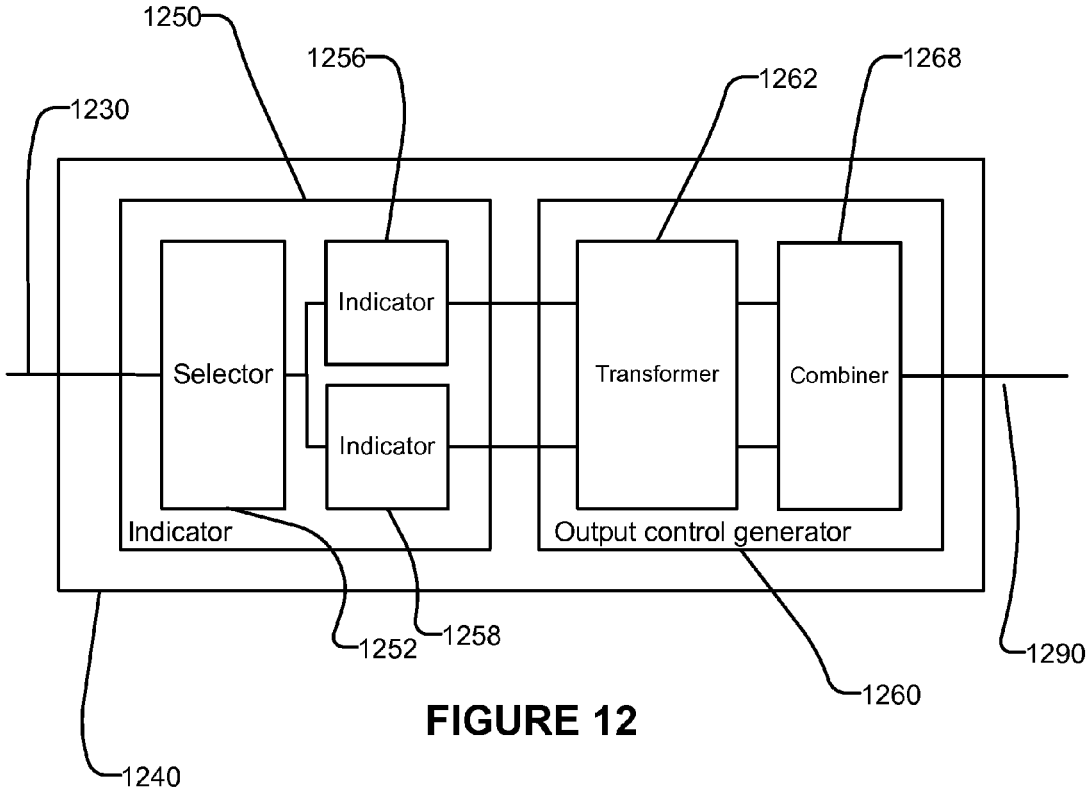
FIG. 12 is a block diagram of an illumination source controller according to an example embodiment of the invention.

FIG. 12 shows an illumination source controller 1240 according to an example embodiment of the invention. Image brightness indicator 1250 receives input image data along input pathway 1230. Data selector 1252 extracts subsets of input image data which correspond to spatial regions of an image.

Image brightness indicators 1256 and 1258 determine image brightness indications from the subsets of image data provided to them by data selector 1252. Subsets of image data may be provided, for example, by using pointers to identify subsets of data within a memory containing the received input image data, or by storing subsets of image data in particular regions of a memory.

In some embodiments, image brightness indicator 1256 may determine a central tendency brightness indication. In some embodiments, image brightness indicator 1258 may determine an upper extreme brightness indication. In some embodiments, image brightness indicators 1256 and 1258 may each determine a plurality of image brightness indications. In some embodiments, image brightness indicators 1256 and 1258 may be combined.

Image brightness indications determined by image brightness indicators 1256 and 1258 are provided to output control generator 1260. Image brightness indication transformer 1262 transforms one or more image brightness indications determined from one or more subsets of image data. In some embodiments, image brightness indications are represented numerically and transformed by mathematical operations. In some embodiments, image brightness indication transformations may comprise using a key, or keys to look-up values in one or more lookup tables. Such a key may comprise, for example, an image brightness indication or the result of a combination image brightness indications.

Combiner 1268 combines the outputs of image brightness indication transformer 1262 to create a control output on output path 1290. Output path may be connected to an illumination element configured to provide illumination to at least part of the spatial region(s) of the image that correspond(s) to the subset(s) of image data. In some embodiments combiner 1268 may compute a sum of the outputs of image brightness indication transformer 1262.

Figure 13:
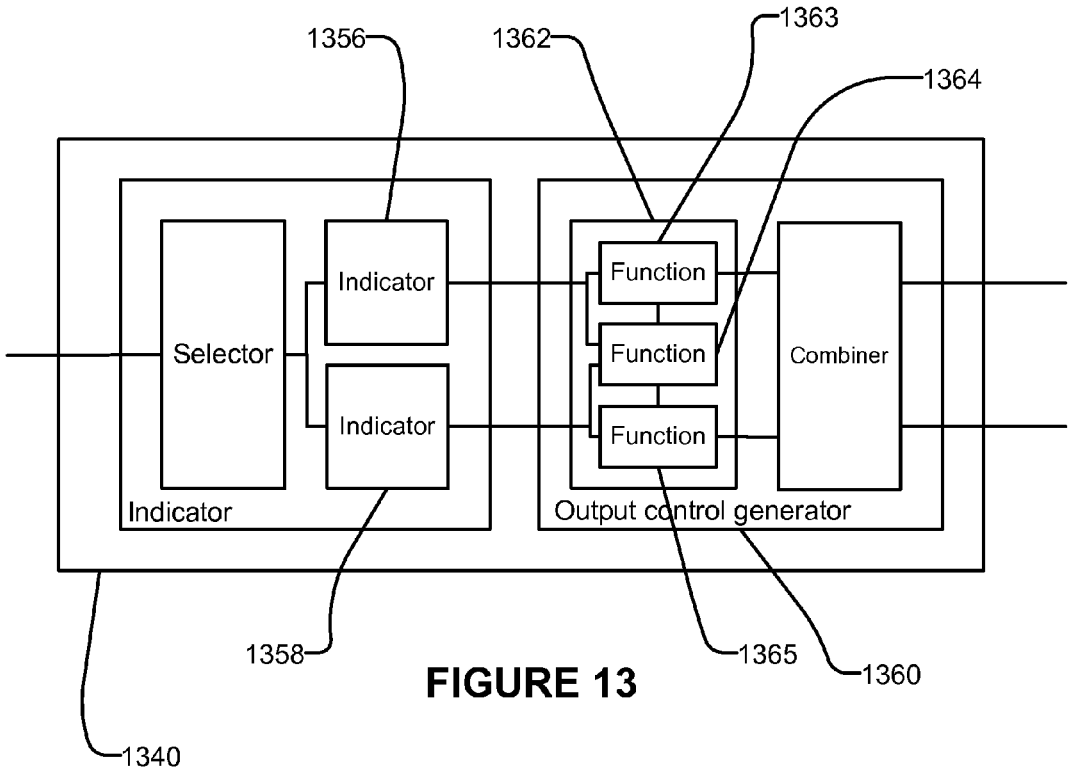
FIG. 13 is a block diagram of an illumination source controller according to an example embodiment of the invention.

FIG. 13 shows an illumination source controller 1340 according to an example embodiment of the invention. Image brightness indicator 1356 determines a central tendency brightness indication from a subset of image data provided to it by image data selector 1252. Image brightness indicator 1358 determines an upper extreme brightness indication from a subset of image data provided to it by image data selector 1252. Output control generator 1360 comprises image brightness indication transformer 1362, which in turn comprises function blocks 1363, 1364, and 1365. Function block 1364 receives a central tendency brightness indication determined by image brightness indicator 1356 and an upper extreme brightness indication determined by image brightness indicator 1358. Function block 1364 determines an output, which is provided to function blocks 1363 and 1365. Function block 1363 performs one or more functions which take as input either or both of the central tendency brightness indication determined by image brightness indicator 1356 and the output of function block 1364. Function block 1365 performs one or more functions which take as input either or both of an upper extreme brightness indication determined by the image brightness indicator 1358 and the output of function block 1364.

In some embodiments, function block 1364 computes a difference between the image brightness indications determined in image brightness indicators 1356 and 1358. In some embodiments, function blocks 1363 and 1365 scale input image indications according to this difference. In some such embodiments, blocks 1363 and 1365 scale input image indications by calculating products of scaling values and image indications. For example, function block 1363 may obtain a scaling value and output the product of the scaling value and a central tendency image indication. Blocks 1363 and 1365 may obtain scaling values by use of computable functions, look-up tables or other suitable means. In some embodiments, the scaling value applied to the central tendency image indication may be subject to a minimum value. In some embodiments, the scaling values obtained by blocks 1363 and 1365 are normalized, such that they sum to a constant value.

In other embodiments, blocks 1363 and 1365 scale image brightness indications by directly computing scaled outputs. Blocks 1363 and 1365 may directly compute scaled output values by use of computable functions, look-up tables or other suitable means. For example, function block 1366 may directly scale an upper extreme brightness indication by using the upper extreme brightness indication and a difference determined by block 1364 as keys, or a key, to obtain a scaled output upper extreme brightness indication from a look-up table.

Figure 14:
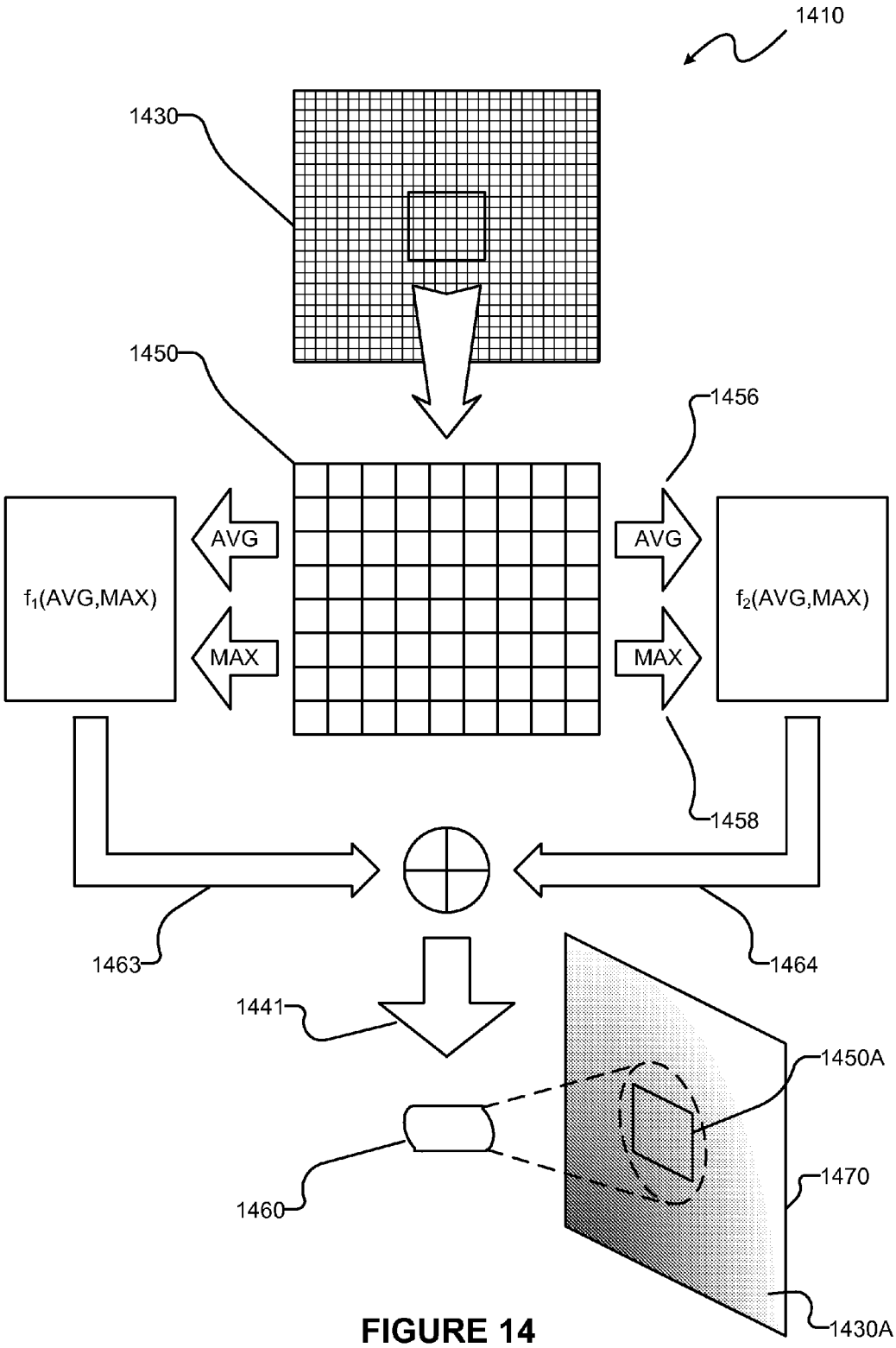
FIG. 14 is a diagrammatic illustration of a method according to an example embodiment of the invention.

FIG. 14 shows a diagrammatic illustration of a method 1410 according to an example embodiment of the invention. A subset 1450 of input image data 1430 is selected. Subset 1450 corresponds to a region 1450A of an image 1430A specified by input image data 1430. From subset 1450, central tendency and upper extreme brightness indications 1456 and 1458 are determined. Central tendency and upper extreme brightness indications 1456 and 1458 may be determined serially or in parallel. In some embodiments the central tendency and upper extreme brightness indicators respectively comprise an average brightness and a maximum brightness for the area.

Central tendency and upper extreme brightness indications 1456 and 1458 are combined to yield intermediate outputs 1463 and 1464. Intermediate outputs 1463 and 1464 are combined to yield control output 1441. Control output 1441 controls illumination element 1460. Illumination element 1460 is disposed to provide illumination to at least part of the area of light modulator 1470 on which is displayed region 1450A of image 1430A.

Figure 15:
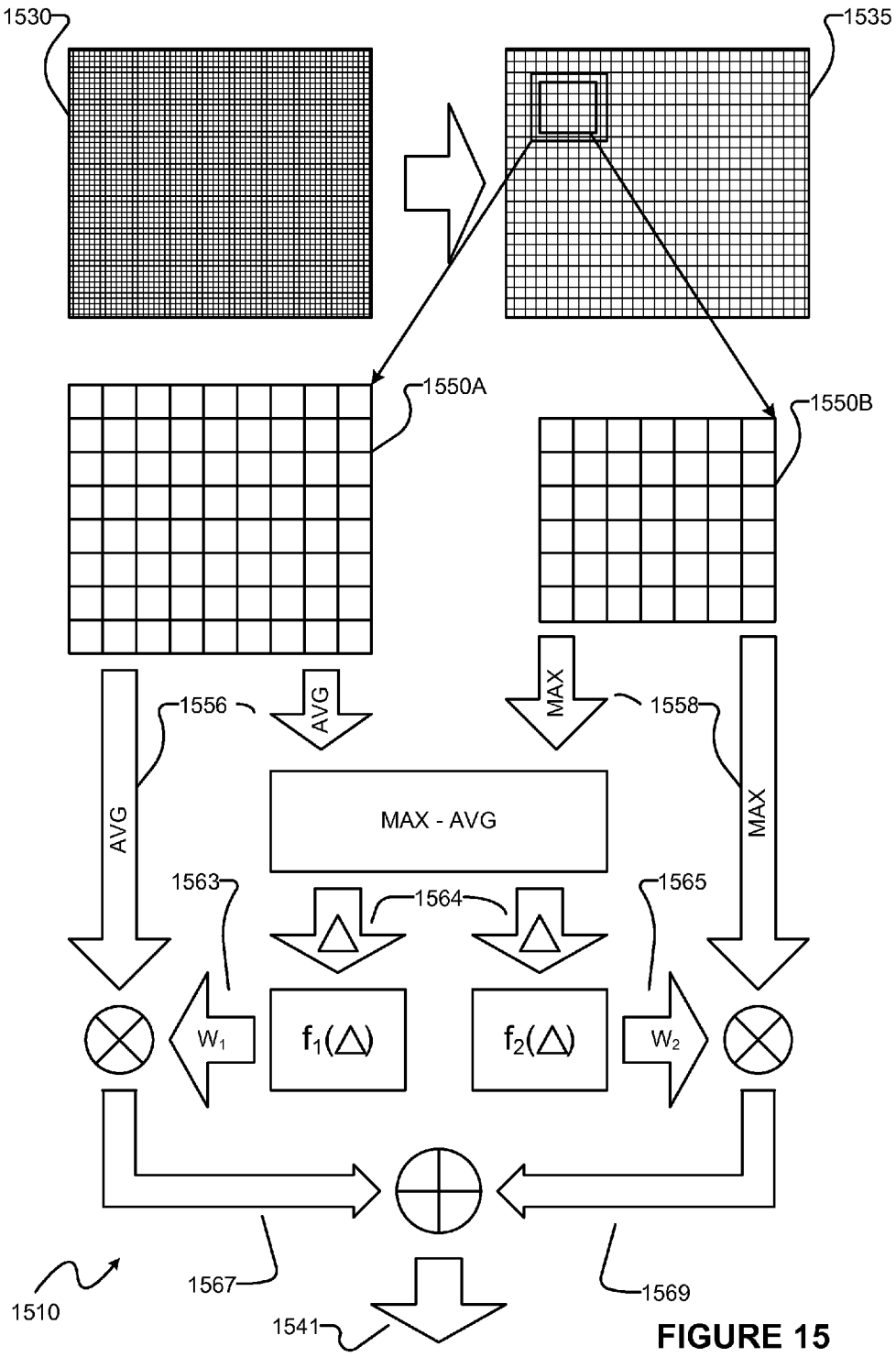
FIG. 15 is a diagrammatic illustration of a method according to an example embodiment of the invention.

FIG. 15 shows a diagrammatic illustration of a method 1510 according to an example embodiment of the invention. Input image data 1530 is downsampled to yield downsampled image data 1535. Subsets 1550A and 1550B of downsampled image data 1535 are selected. Subsets 1550A and 1550B correspond to regions 1552A and 1552B (not shown) of an image 1530A (not shown) specified by input image data 1530. From subset 1550A, central tendency brightness indication 1556 is determined. From subset 1550B, upper extreme brightness indication 1558 is determined. Central tendency brightness indication 1556 and upper extreme brightness indication 1558 may be determined serially or in parallel. A difference 1564 between upper extreme brightness indication 1558 and central tendency brightness indication 1556 is determined. First and second weighting values 1563 and 1565 are determined from difference 1564.

Weighting values may be determined by a computable function taking difference 1564 as input, by a use of a lookup tables taking difference 1564 as a key, or by other suitable means. In some embodiments, weighting values are normalized, for example, by scaling after being initially determined, or by coordinating the means by which the weighting values are determined (e.g., complementary computable functions or complementary lookup table values). The limit to which weighting values are normalized may depend on one or more properties of illumination elements or light modulation elements, and/or on user input. In some embodiments, one or both weighting values are constrained by minimum and maximum values. For example, a weighting value applied to a central tendency brightness indication may be subject to a minimum. Such minimum and maximum values may be selected based upon one or more properties of illumination elements or light modulation elements, and/or on user input.

First weighting value 1563 is multiplied by central tendency brightness indication 1556 to yield central tendency term 1567. Second weighting value 1565 is multiplied by upper extreme brightness indication 1558 to yield upper extreme term 1569. Central tendency term 1567 and upper extreme term 1569 are added together to yield control output 1541. In some embodiments, control output 1541 may be used to control an illumination element configured to provide illumination to at least part of the area of a light modulator on which is displayed region 1552A. In other embodiments, control output 1541 may be used to control an illumination element configured to provide illumination to at least part of the area of a light modulator on which is displayed region 1552B.

In a simple example embodiment of the invention, a driving valve for an illumination source is obtained by identifying a maximum brightness value and an average brightness value specified for pixels in an image area corresponding to the illumination source. The difference between the maximum and average brightness values is computed. Weights for the maximum and average brightness values are determined based on the difference. The average and maximum brightness values are multiplied respectively by the corresponding weight and the resulting products are summed to yield the driving value. In some embodiments the weights are normalized (i.e. the sum of the weights is constant). In some embodiments the weight associated with the average brightness is at least a preset minimum weight for all possible differences. This method may be performed in a display controller to generate driving signals for illumination sources of a backlight, for example.

Certain implementations of the invention comprise computer processors which execute software instructions which cause the processors to perform a method of the invention. For example, illumination source controllers and light modulation controllers may comprise one or more processors that implement methods as described herein, as shown, for example, in FIGS. 5, 6, 7, 14 and 15, by executing software instructions from a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Where a component (e.g. a software module, controller, indicator, generator, selector, transformer, combiner, processor, assembly, device, circuit, logic, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

Various embodiments of the present invention may relate to one or more of the Enumerated Example Embodiments (EEEs) below, each of which are examples, and, as with any other related discussion provided above, should not be construed as limiting any claim or claims provided yet further below as they stand now or as later amended, replaced, or added. Likewise, these examples should not be considered as limiting with respect to any claim or claims of any related patents and/or patent applications (including any foreign or international counterpart applications and/or patents, divisionals, continuations, re-issues, etc.). Examples:

EEE1. Apparatus for controlling an illumination element in a display, the apparatus comprising:
- a processor configured to:
- for image data corresponding to an image, select from the image data at least one subset of image data, the at least one subset of image data corresponding an image region at least partially illuminated by the illumination element;
- determine a first image brightness indication from the at least one subset of image data;
- determine a second image brightness indication from the at least one subset of image data, the second image brightness indication different from the first image brightness indication; and
- control the illumination element based at least in part on a combination of the first and second image brightness indications.

EEE2. Apparatus according to EEE 1 wherein the first image brightness indication comprises an upper extreme brightness indication.

EEE3. Apparatus according to EEE 2 wherein the upper extreme brightness indication comprises a maximum.

EEE4. Apparatus according to EEE 2 wherein the upper extreme brightness indication comprises an order statistic.

EEE5. Apparatus according to EEE 2 wherein the upper extreme brightness indication comprises minimum frequency maximum.

EEE6. Apparatus according to EEE 2 wherein the upper extreme brightness indication comprises a value typifying a maximum brightness subset.

EEE7. Apparatus according to EEE 6 wherein the maximum brightness subset corresponds to a spatial image region.

EEE8. Apparatus according to EEE 6 wherein the maximum brightness subset corresponds at least two discontiguous spatial regions of the image.

EEE9. Apparatus according to any one of EEEs 6 to 8 wherein the value typifying the maximum brightness subset comprises a brightness of an element of the maximum brightness subset.

EEE10. Apparatus according to any one of EEEs 6 to 8 wherein the value typifying the maximum brightness subset comprises a minimum brightness of elements in the maximum brightness subset.

EEE11. Apparatus according to any one of EEEs 6 to 8 wherein the value typifying the maximum brightness subset comprises a central tendency brightness indication of the maximum brightness subset.

EEE12. Apparatus according to any one of EEEs 1 to 11 wherein the second image brightness indication comprises a central tendency brightness indication.

EEE13. Apparatus according to any one of EEEs 11 and 12 wherein the central tendency brightness indication comprises a mean.

EEE14. Apparatus according to any one of EEEs 11 and 12 wherein the central tendency brightness indication comprises a weighted arithmetic mean.

EEE15. Apparatus according to EEE 14 wherein the weighted arithmetic mean comprises weights according to a point spread function of the illumination element.

EEE16. Apparatus according to any one of EEEs 11 and 12 wherein the central tendency brightness indication comprises a truncated mean.

EEE17. Apparatus according to any one of EEEs 11 and 12 wherein the central tendency brightness indication comprises a median.

EEE18. Apparatus according to any one of EEEs 11 and 12 wherein the central tendency brightness indication comprises a discretized mode.

EEE19. Apparatus according to any one of EEEs 11 and 12 wherein the central tendency brightness indication comprises a measure of a size of a population of image elements having more than a threshold brightness.

EEE20. Apparatus according to any one of EEEs 11 and 12 wherein the central tendency brightness indication comprises a sum of numerical representations of image element brightnesses.

EEE21. Apparatus according to any one of EEEs 1 to 20 wherein combining the first and second image brightness indications comprises adding a first product and a second product, the first product comprising a product of the first image brightness indication and a first weight, and the second product comprising a product of the second image brightness indication and a second weight.

EEE22. Apparatus according to EEE 21 wherein a ratio of the second weight to the first weight comprises a function that increases with an absolute difference between the first and second image brightness indications.

EEE23. Apparatus according to any one of EEEs 21 to 22 wherein the processer is configured to normalize the first weight and the second weight to a constant value.

EEE24. Apparatus according to any one of EEEs 21 to 22 wherein the processer is configured to set a minimum value for at least one of the first weight and the second weight.

EEE25. Apparatus according to EEE 21 wherein a ratio of the second weight to the first weight comprises a function that increases with a dispersion indication of the at least one subset of image data.

EEE26. Apparatus according to EEE 25 wherein the dispersion indication comprises a variance.

EEE27. Apparatus according to EEE 25 wherein the dispersion indication comprises a standard deviation.

EEE28. Apparatus according to EEE 25 wherein the dispersion indication comprises a median absolute deviation.

EEE29. Apparatus according to EEE 25 wherein the dispersion indication comprises an average absolute deviation.

EEE30. Apparatus according to EEE 25 wherein the dispersion indication comprises a mean difference.

EEE31. Apparatus according to EEE 25 wherein the dispersion indication comprises an interquartile range.

EEE32. Apparatus according to any one of EEEs 1 to 31 wherein the at least one subset comprises a first subset and a second subset, the subsets corresponding respectively to a first region of the image and a second region of the image, and wherein the processor is configured to determine the first brightness indication from the first subset and to determine the second brightness indication from the second subset.

EEE33. Apparatus according to any one of EEEs 1 to 32 wherein the first region is larger than the second region.

EEE34. Apparatus according to any one of EEEs 1 to 32 wherein the second region is larger than the first region.

EEE35. Apparatus according to any one of EEEs 1 to 34 wherein at least one of the first and second regions corresponds to a rectangular block of the image data.

EEE36. Apparatus according to any one of EEEs 1 to 34 wherein at least one of the first and second regions corresponds to a square block of the image data.

EEE37. Apparatus according to any one of EEEs 1 to 34 wherein at least one of the first and second regions is provided at least a threshold fraction of light emitted by the illumination element.

EEE38. Apparatus according to any one of EEEs 1 to 34 wherein at least one of the first and second regions is disposed within an area of the image that is provided at least a threshold fraction of light emitted by the illumination element.

EEE39. Apparatus according to any one of EEEs 1 to 34 wherein at least one of the first and second regions encompasses an area of the image that is provided at least a threshold fraction of the light emitted by the illumination element.

EEE40. Apparatus according to any one of EEEs 1 to 39 wherein determining at least one of the first and second brightness indications comprises computing a function of color space components of the image data that are representative of brightness.

EEE41. Apparatus according EEEs 1 to 39 wherein determining at least one of the first and second brightness indications comprises computing at least one brightness component based at least in part on a function of color space components of the image data.

EEE42. Apparatus according to EEEs 1 to 40 wherein determining at least one of the first and second brightness indications comprises computing a function of the image data scaled according to a point spread function of the illumination element.

EEE43. Apparatus according to any one of EEEs 1 to 42 wherein the processer is configured to downsample the image data and to determine at least one of the first and second brightness indications from downsampled image data.

EEE44. A method for controlling an illumination element in a display, the method comprising:

for image data corresponding to an image, selecting from the image data at least one subset of image data, the at least one subset of image data corresponding to an image region at least partially illuminated by the illumination element;

determining a first image brightness indication from the at least one subset of image data;

determining a second image brightness indication from the at least one subset of image data, the second image brightness indication different from the first image brightness indication;

combining the first and second image brightness indications to yield a combination; and controlling the illumination element based at least in part on the combination.

EEE45. A method according to EEE 44 wherein the first image brightness indication comprises an upper extreme brightness indication.

EEE46. A method according to EEE 45 wherein the upper extreme brightness indication comprises a maximum.

EEE47. A method according to EEE 45 wherein the upper extreme brightness indication comprises an order statistic.

EEE48. A method according to EEE 45 wherein the upper extreme brightness indication comprises minimum frequency maximum.

EEE49. A method according to EEE 45 wherein the upper extreme brightness indication comprises a value typifying a maximum brightness subset.

EEE50. A method according to EEE 49 wherein the maximum brightness subset corresponds to a spatial image region.

EEE51. A method according to EEE 49 wherein the maximum brightness subset corresponds at least two discontiguous spatial regions of the image.

EEE52. A method according to any one of EEEs 49 to 52 wherein the value typifying the maximum brightness subset comprises a brightness of an element of the maximum brightness subset.

EEE53. A method according to any one of EEEs 49 to 52 wherein the value typifying the maximum brightness subset comprises a minimum brightness of elements in the maximum brightness subset.

EEE54. A method according to any one of EEEs 49 to 52 wherein the value typifying the maximum brightness subset comprises a central tendency brightness indication of the maximum brightness subset.

EEE55. A method according to any one of EEEs 44 to 54 wherein the second image brightness indication comprises a central tendency brightness indication.

EEE56. A method according to any one of EEEs 54 and 55 wherein the central tendency brightness indication comprises a mean.

EEE57. A method according to any one of EEEs 54 and 55 wherein the central tendency brightness indication comprises a weighted arithmetic mean.

EEE58. A method according to EEE 57 wherein the weighted arithmetic mean comprises weights according to a point spread function of the illumination element.

EEE59. A method according to any one of EEEs 54 and 55 wherein the central tendency brightness indication comprises a truncated mean.

EEE60. A method according to any one of EEEs 54 and 55 wherein the central tendency brightness indication comprises a median.

EEE61. A method according to any one of EEEs 54 and 55 wherein the central tendency brightness indication comprises a discretized mode.

EEE62. A method according to any one of EEEs 54 and 55 wherein the central tendency brightness indication comprises a measure of a size of a population of image elements of more than a threshold brightness.

EEE63. A method according to EEE 55 wherein the central tendency brightness indication comprises a sum of numerical representations of image element brightnesses.

EEE64. A method according to any one of EEEs 44 to 63 wherein combining the first and second image brightness indications comprises adding a first product and a second product, the first product comprising a product of the first image brightness and a first weight, and the second product comprising a product of the second image brightness indication and a second weight.

EEE65. A method according to EEE 64 wherein combining the first and second image brightness indications comprises determining the first weight based at least in part on a first function; and determining the second weight based at least in part on a second function;

wherein at least one of the first and second functions depends at least in part on at least one of the first and second image brightness indications, and wherein a ratio of an output of the second function to an output of the first function increases with an absolute difference between the first and second image brightness indications.

EEE66. A method according to any one of EEEs 64 to 65 comprising normalizing the first weight and the second weight so that the sum of the first weight and the second weight is equal to a constant value.

EEE67. A method according to any one of EEEs 64 to 65 comprising, if the second weight is less than a minimum value then setting the second weight to at least the minimum value.

EEE68. A method according to EEE 64 wherein combining the first and second image brightness indications comprises determining the first weight based at least in part on a first function; and determining the second weight based at least in part on a second function;

wherein at least one of the first and second functions depends at least in part on at least one of the first and second image brightness indications, and wherein a ratio of an output of the second function to an output of the first function increases with a dispersion indication of the at least one subset.

EEE69. A method according to EEE 68 wherein the dispersion indication comprises a variance.

EEE70. A method according to EEE 68 wherein the dispersion indication comprises a standard deviation.

EEE71. A method according to EEE 68 wherein the dispersion indication comprises a median absolute deviation.

EEE72. A method according to EEE 68 wherein the dispersion indication comprises an average absolute deviation.

EEE73. A method according to EEE 68 wherein the dispersion indication comprises a mean difference.

to EEE74. A method according to EEE 68 wherein the dispersion indication comprises an interquartile range.

EEE75. A method according to any one of EEEs 44 to 74 wherein selecting the at least one subset comprises selecting a first subset and a second subset, the subsets corresponding respectively to a first region of the image and a second region of the image; and wherein determining the first brightness indication from the at least one subset comprises determining the first brightness indication from the first subset and determining the second brightness indication from the at least one subset comprises determining the second brightness indication from the second subset.

EEE76. A method according to EEE 75 wherein the first region is larger than the second region.

EEE77. A method according to EEE 75 wherein the second region is larger than the first region.

EEE78. A method according to EEE 75 wherein at least one of the first and second regions corresponds to a rectangular block of image data.

EEE79. Apparatus according to EEE 75 wherein at least one of the first and second regions corresponds to a square block of image data.

EEE80. A method according to any one of EEEs 75 to 78 wherein at least one of the first and second regions is provided at least a threshold fraction of light emitted by the illumination element.

EEE81. A method according to any one of EEEs 75 to 78 wherein at least one of the first and second regions is disposed within an area of the image that is provided at least a threshold fraction of light emitted by the illumination element.

EEE82. A method according to any one of EEEs 75 to 78 wherein at least one of the first and second regions encompasses an area of the image provided at least a threshold fraction of light emitted by the illumination element.

EEE83. A method according to any one of EEEs 44 to 83 wherein determining at least one of the first and second brightness indications comprises computing a function of a color space component of the image data representative of brightness.

EEE84. A method according to any one of EEEs 44 to 83 wherein determining at least one of the first and second brightness indications comprises computing at least one brightness component based at least in part on a function of color space components of the image data.

EEE85. A method according EEEs 44 to 85 comprising scaling the image data according to a point spread function of the illumination element to yield scaled image data, wherein at least one of the first and second brightness indications are determined from the scaled image data.

EEE86. A method according to any one of EEEs 44 to 86 comprising downsampling the image data, wherein the at least one subset is selected from downsampled image data.

EEE87. A method for controlling an intensity of light emitted by a light source in a display, the method comprising:

selecting from image data representing an image to be displayed pixel values corresponding to a region of the image to be illuminated by the light source;

determining both an upper extreme brightness indication and a central tendency brightness indication for the selected pixels; and determining a driving value for the light source based at least in part on a combination of the upper extreme brightness indication and the central tendency brightness indication.

EEE88. A method according to EEE 88 wherein the combination comprises a weighted average.

EEE89. A method according to EEE 89 wherein a ratio of a weight for the central tendency brightness indication to a weight for the upper extreme brightness increases with an absolute difference between the upper extreme brightness indication and the central tendency brightness indication.

EEE90. A method according to EEE 89 comprising normalizing the first and second weights so that the first and second weights sum to a constant value.

EEE91. Apparatus comprising any useful and inventive feature, combination of features or sub-combination of features as described herein.

EEE92. A method comprising any useful and inventive step, act, combination of steps and/or acts or sub-combination of steps and/or acts as described herein.

The invention claimed is:

1. Apparatus for controlling an illumination element of a backlight in a display, the apparatus comprising:

a processor configured to:

for image data corresponding to an image, select from the image data a first subset of image data and a second subset of image data, wherein the subsets correspond respectively to a first region of the image and a second region of the image, wherein the second region encompasses the first region, and wherein the first region and the second region are at least partially illuminated according to a point spread function of the illumination element;

determine a first image brightness indication from the first subset of image data;

determine a second image brightness indication from the second subset of image data, the second image brightness indication different from the first image brightness indication; and control the illumination element based at least in part on a combination of the first and second image brightness indication.

2. Apparatus according to claim 1 wherein the first image brightness indication comprises an upper extreme brightness indication.

3. Apparatus according to claim 2 wherein the first subset of image data or the second subset of image data comprises a plurality of candidate subsets, and wherein the upper extreme brightness indication comprises a value typifying a maximum brightness in one of the plurality of candidate subsets having image data with the greatest number of image elements with a brightness above a threshold among the plurality of candidate subsets.

4. Apparatus according to claim 3 wherein the maximum brightness for one of the plurality of candidate subsets corresponds to at least two discontiguous spatial regions of the image.

5. Apparatus according to claim 1 wherein combining the first and second image brightness indications comprises adding a first product and a second product, the first product comprising a product of the first image brightness indication and a first weight, and the second product comprising a product of the second image brightness indication and a second weight.

6. Apparatus according to claim 5 wherein a ratio of the second weight to the first weight comprises a function that increases with an absolute difference between the first and second image brightness indications.

7. Apparatus according to claim 5 wherein a ratio of the second weight to the first weight comprises a function that increases with a dispersion indication of the first subset or the second subset of image data, and wherein the dispersion indication is an indication of variability or spread of intensities of light required to be provided to a light modulator to make the bulk of a set of image elements appear as specified by image data.

8. Apparatus according to claim 7 wherein the dispersion indication comprises at least one of a range, a variance, a standard deviation, an interquartile range, a mean difference, a median absolute deviation, an average absolute deviation, and a dimensionless statistical measure of dispersion or variability of the brightness of a set of image elements.

9. Apparatus according to claim 1 wherein determining at least one of the first and second brightness indications comprises computing a function of color space components of the image data that are representative of brightness.

10. Apparatus according to claim 1 wherein determining at least one of the first and second brightness indications comprises computing a function of the image data scaled according to a point spread function of the illumination element.

11. Apparatus according to claim 1 wherein the processer is configured to downsample the image data and to determine at least one of the first and second brightness indications from downsampled image data.

12. A method for controlling an illumination element in a display, the method comprising:

for image data corresponding to an image, selecting from the image data a first subset of image data and a second subset of image data, wherein the subsets correspond respectively to a first region of the image and a second region of the image, wherein the second region encompasses the first region, and wherein the first region and the second region are at least partially illuminated according to a point spread function of the illumination element;

determining a first image brightness indication from the first subset of image data;

determining a second image brightness indication from the second subset of image data, the second image brightness indication different from the first image brightness indication;

combining the first and second image brightness indications to yield a combination; and controlling the illumination element based at least in part on the combination.

13. A method according to claim 12 wherein combining the first and second image brightness indications comprises adding a first product and a second product, the first product comprising a product of the first image brightness and a first weight, and the second product comprising a product of the second image brightness indication and a second weight.

14. A method according to claim 13 wherein combining the first and second image brightness indications comprises determining the first weight based at least in part on a first function; and determining the second weight based at least in part on a second function;

wherein at least one of the first and second functions depends at least in part on at least one of the first and second image brightness indications, and wherein a ratio of an output of the second function to an output of the first function increases with an absolute difference between the first and second image brightness indications.

15. A method according to claim 14 comprising normalizing the first weight and the second weight so that the sum of the first weight and the second weight is equal to a constant value.

16. A method according to claim 13 wherein combining the first and second image brightness indications comprises determining the first weight based at least in part on a first function; and determining the second weight based at least in part on a second function;

wherein at least one of the first and second functions depends at least in part on at least one of the first and second image brightness indications, and wherein a ratio of an output of the second function to an output of the first function increases with a dispersion indication of the at least one subset.

* * * * *